US009026024B2

(12) United States Patent
Ogawa et al.

(10) Patent No.: US 9,026,024 B2
(45) **Date of Patent: *May 5, 2015**

(54) FIXING DEVICE CAPABLE OF MINIMIZING DAMAGE OF ENDLESS ROTARY BODY AND IMAGE FORMING APPARATUS INCORPORATING SAME

(71) Applicant: Ricoh Company, Ltd., Tokyo (JP)

(72) Inventors: Tadashi Ogawa, Tokyo (JP); Masahiko Satoh, Tokyo (JP); Masaaki Yoshikawa, Tokyo (JP); Hiroshi Yoshinaga, Chiba (JP); Kenji Ishii, Kanagawa (JP); Takeshi Uchitani, Kanagawa (JP); Hiromasa Takagi, Tokyo (JP); Naoki Iwaya, Tokyo (JP); Takuya Seshita, Kanagawa (JP); Takahiro Imada, Kanagawa (JP); Hajime Gotoh, Kanagawa (JP); Takamasa Hase, Shizuoka (JP); Kazuya Saito, Kanagawa (JP); Toshihiko Shimokawa, Kanagawa (JP); Shuutaroh Yuasa, Kanagawa (JP); Teppei Kawata, Kanagawa (JP); Arinobu Yoshiura, Kanagawa (JP); Kensuke Yamaji, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 10 days.

This patent is subject to a terminal disclaimer.

(21) Appl. No.: 13/746,871

(22) Filed: Jan. 22, 2013

(65) Prior Publication Data

US 2013/0209147 A1 Aug. 15, 2013

(30) Foreign Application Priority Data

Feb. 9, 2012 (JP) ..... 2012-026628
Nov. 30, 2012 (JP) ..... 2012-262077

(51) Int. Cl.
*G03G 15/20* (2006.01)

(52) U.S. Cl.
CPC ..... *G03G 15/2017* (2013.01); *G03G 15/2028* (2013.01); *G03G 15/205* (2013.01); *G03G 15/2053* (2013.01); *G03G 2215/2035* (2013.01)

(58) Field of Classification Search
CPC ..... G03G 15/2042; G03G 15/2017; G03G 15/2082
See application file for complete search history.

(56) References Cited

U.S. PATENT DOCUMENTS 7,088,931 B2 * 8/2006 Kojima ..... 399/38

(Continued)

FOREIGN PATENT DOCUMENTS

CN 1763652 A 4/2006

(Continued)

OTHER PUBLICATIONS

U.S. Appl. No. 13/557,841, filed Jul. 25, 2012, Toshihiko Shimokawa, et al.

(Continued)

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

A fixing device includes at least one heater disposed opposite an inner circumferential surface of an endless rotary body to heat the endless rotary body and a shield interposed between the endless rotary body and the at least one heater to shield the endless rotary body from heat radiated from the at least one heater. A first size recording medium passes over a first passage region of the endless rotary body and a second size recording medium passes over a second passage region of the endless rotary body. The shield includes a notch disposed opposite a lateral end of the second passage region of the endless rotary body in an axial direction thereof. The lateral end of the second passage region overlaps a non-passage region of the endless rotary body in the axial direction thereof where the first size recording medium does not pass.

13 Claims, 13 Drawing Sheets

(56) References Cited

U.S. PATENT DOCUMENTS

| | | | | |
|---|---|---|---|---|
| 7,437,113 | B2 * | 10/2008 | Suzuki et al. | 399/328 |
| 7,773,931 | B2 * | 8/2010 | Jung et al. | 399/329 |
| 7,842,906 | B2 * | 11/2010 | Takematsu et al. | 219/619 |
| 8,351,807 | B2 * | 1/2013 | Seki | 399/45 |
| 2006/0029411 | A1 | 2/2006 | Ishii et al. | |
| 2007/0212089 | A1 | 9/2007 | Seo et al. | |
| 2007/0242988 | A1 | 10/2007 | Seo et al. | |
| 2007/0280754 | A1 | 12/2007 | Ogawa et al. | |
| 2007/0292175 | A1 | 12/2007 | Shinshi | |
| 2008/0025772 | A1 | 1/2008 | Seo et al. | |
| 2008/0025773 | A1 | 1/2008 | Ito et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2008/0298862 | A1 | 12/2008 | Shinshi | |
| 2009/0110451 | A1 | 4/2009 | Jung et al. | |
| 2009/0116884 | A1 | 5/2009 | Nonaka et al. | |
| 2009/0123201 | A1 | 5/2009 | Ehara et al. | |
| 2009/0148205 | A1 | 6/2009 | Seo et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0067929 | A1 | 3/2010 | Seki | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085815 | A1 | 4/2011 | Kishi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176821 | A1 | 7/2011 | Hase | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229162 | A1 | 9/2011 | Ogawa et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |

FOREIGN PATENT DOCUMENTS

| | | | |
|---|---|---|---|
| CN | 101673078 | A | 3/2010 |
| CN | 103207554 | A | 7/2013 |
| JP | 2003-091185 | | 3/2003 |
| JP | 2004-286922 | | 10/2004 |
| JP | 2007-334205 | | 12/2007 |
| JP | 2008-065002 | | 3/2008 |
| JP | 2008-129517 | | 6/2008 |
| JP | 2009-003410 | | 1/2009 |
| JP | 2009-042305 | | 2/2009 |
| JP | 2009-115969 | | 5/2009 |
| JP | 2010-032625 | | 2/2010 |
| JP | 2010-066583 | | 3/2010 |
| JP | 2010-096782 | | 4/2010 |
| JP | 2010-217209 | | 9/2010 |
| JP | 2010-217210 | | 9/2010 |

OTHER PUBLICATIONS

Office Action issued in Chinese Application No. 201310042574.0 on Feb. 17, 2015.

* cited by examiner

FIXING DEVICE CAPABLE OF MINIMIZING DAMAGE OF ENDLESS ROTARY BODY AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2012-026628, filed on Feb. 9, 2012, and 2012-262077, filed on Nov. 30, 2012, in the Japanese Patent Office, the entire disclosure of each of which is hereby incorporated by reference herein.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device is requested to shorten a first print time taken to output the recording medium bearing the toner image onto the outside of the image forming apparatus after the image forming apparatus receives a print job. Additionally, the fixing device is requested to reduce power consumption.

To address these requests, the fixing device may employ a thin endless belt having a decreased thermal capacity and therefore heated quickly by a heater. For example, a pressing roller is pressed against a nip formation assembly disposed inside a loop formed by the endless belt to form a fixing nip between the pressing roller and the endless belt. The heater disposed inside the loop formed by the endless belt heats the endless belt throughout the width in the axial direction thereof. As the pressing roller and the endless belt rotate and convey the recording medium bearing the toner image through the fixing nip, the endless belt and the pressing roller apply heat and pressure to the recording medium, thus fixing the toner image on the recording medium. Since the heater heats the endless belt directly, the endless belt is heated to a predetermined fixing temperature quickly, thus meeting the above-described requests of shortening the first print time and reducing power consumption.

As the recording medium bearing the toner image passes through the fixing nip, it travels over a center of the endless belt in the axial direction thereof. Accordingly, both lateral ends of the endless belt in the axial direction thereof where the recording medium does not travel are subject to damage, for example, thermal damage and mechanical damage.

For example, as the recording medium travels over the center of the endless belt in the axial direction thereof, it draws heat from the center of the endless belt. Conversely, at both lateral ends of the endless belt in the axial direction thereof where the recording medium does not travel, heat is not drawn therefrom to the recording medium. Accordingly, both lateral ends of the endless belt may overheat, resulting in thermal damage of the endless belt.

On the other hand, as the recording medium is discharged from the fixing nip, it may adhere to the endless belt and thereby may not be discharged from the fixing device smoothly. To address this problem, a separator may be disposed opposite the outer circumferential surface of the endless belt at each lateral end of the endless belt in the axial direction thereof. As the recording medium is discharged from the fixing nip, the separator comes into contact with the leading edge of the recording medium, separating the recording medium from the endless belt. However, if the recording medium is accidentally jammed between the endless belt and the separator, a user may pull the jammed recording medium upward to remove it from between the endless belt and the separator. Accordingly, the recording medium pulled upward lifts and spaces the separator apart from the endless belt. However, after the jammed recording medium is removed, the separator no longer lifted by the recording medium may fall and strike the endless belt by resilience of a spring anchored to the separator, thus mechanically deforming or damaging both lateral ends of the endless belt in the axial direction thereof.

SUMMARY OF THE INVENTION

This specification describes below an improved fixing device. In one exemplary embodiment of the present invention, the fixing device includes a hollow, endless rotary body rotatable in a predetermined direction of rotation and a pressing body contacting an outer circumferential surface of the endless rotary body to form a fixing nip therebetween through which a first size recording medium bearing a toner image and a second size recording medium bearing a toner image and being greater than the first size recording medium in width in an axial direction of the endless rotary body pass. The first size recording medium passes over a first passage region of the endless rotary body and the second size recording medium passes over a second passage region of the endless rotary body. At least one heater is disposed opposite an inner circumferential surface of the endless rotary body to heat the endless rotary body. A shield is interposed between the endless rotary body and the at least one heater to shield the endless rotary body from heat radiated from the at least one heater. The shield includes a notch disposed opposite a lateral end of the second passage region of the endless rotary body in the axial direction of the endless rotary body. The lateral end of the second passage region overlaps a non-passage region of the endless rotary body in the axial direction thereof where the first size recording medium does not pass.

This specification further describes an improved fixing device. In one exemplary embodiment of the present invention, the fixing device includes a hollow, endless rotary body rotatable in a predetermined direction of rotation and a heater disposed opposite an inner circumferential surface of the endless rotary body to heat the endless rotary body. The pressing body contacts an outer circumferential surface of the endless rotary body to form a fixing nip therebetween through which a recording medium bearing a toner image passes. A separator is disposed opposite the outer circumferential surface of the endless rotary body to contact and separate the recording medium discharged from the fixing nip from the endless rotary body. A belt holder contacts and supports each lateral end of the endless rotary body in an axial direction of the endless rotary body. The belt holder includes a base; a primary projection projecting from the base toward a center of the endless rotary body in the axial direction thereof; and a secondary projection projecting from a part of the primary projection toward the center of the endless rotary body in the axial direction thereof and disposed opposite the separator via the endless rotary body.

This specification further describes an improved image forming apparatus. In one exemplary embodiment of the present invention, the image forming apparatus includes an image carrier and an electrostatic latent image formation device disposed opposite the image carrier to emit light thereto to form an electrostatic latent image thereon. A development device is disposed opposite the image carrier to supply toner to the electrostatic latent image formed thereon to visualize the electrostatic latent image into a toner image. A transfer device is disposed opposite the image carrier to transfer the toner image formed thereon onto a recording medium. The image forming apparatus further includes the fixing device described above that is disposed downstream from the transfer device in a recording medium conveyance direction to fix the toner image on the recording medium.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
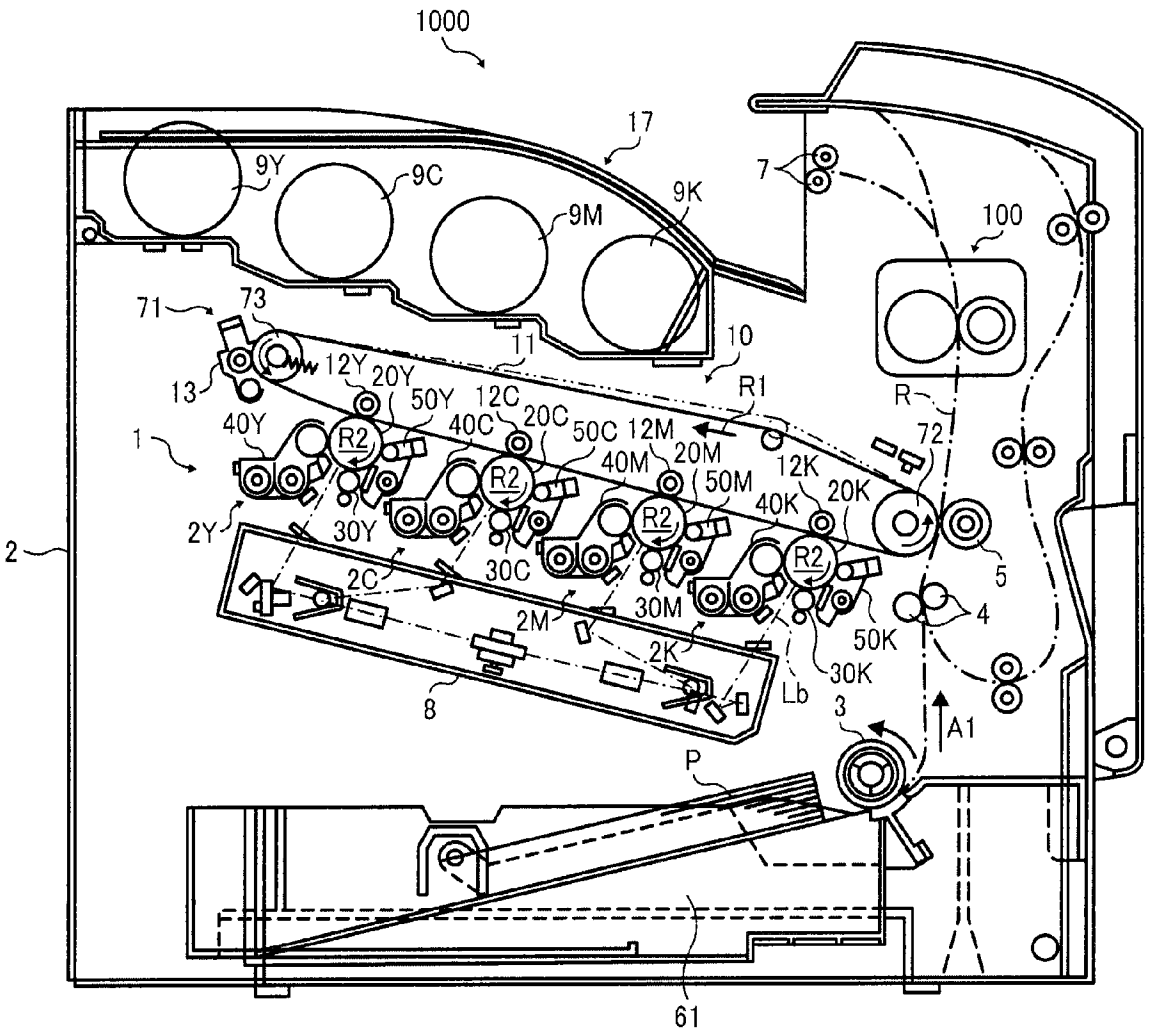
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1000 according to an exemplary embodiment of the present invention is explained.

FIG. 1 is a schematic vertical sectional view of the image forming apparatus 1000. The image forming apparatus 1000 may be a copier, a facsimile machine, a printer, a multifunction printer (MFP) having at least one of copying, printing, scanning, plotter, and facsimile functions, or the like. According to this exemplary embodiment, the image forming apparatus 1000 is a tandem color laser printer that forms color and monochrome toner images on recording media P by electrophotography.

As shown in FIG. 1, the image forming apparatus 1000 includes a body 2 that houses an image forming station 1 situated at a center portion thereof and incorporating four image forming devices 2Y, 2C, 2M, and 2K serving as four process units that form yellow, cyan, magenta, and black toner images, respectively. The image forming devices 2Y, 2C, 2M, and 2K are aligned along a rotation direction R1 of an endless intermediate transfer belt 11 serving as an intermediate transferor. Although the image forming devices 2Y, 2C, 2M, and 2K contain yellow, cyan, magenta, and black developers (e.g., toners) that form yellow, cyan, magenta, and black toner images, respectively, resulting in a color toner image, they have an identical structure.

The image forming devices 2Y, 2C, 2M, and 2K include photoconductive drums 20Y, 20C, 20M, and 20K aligned in the rotation direction R1 of the intermediate transfer belt 11 and serving as a plurality of image carriers that carries the yellow, cyan, magenta, and black toner images, respectively. The visible yellow, cyan, magenta, and black toner images formed on the photoconductive drums 20Y, 20C, 20M, and 20K are primarily transferred onto the intermediate transfer belt 11 that slides over the photoconductive drums 20Y, 20C, 20M, and 20K as it rotates in the rotation direction R1 in a primary transfer process in such a manner that the yellow, cyan, magenta, and black toner images are superimposed on a same position on the intermediate transfer belt 11. Thereafter, the yellow, cyan, magenta, and black toner images superimposed on the intermediate transfer belt 11 are secondarily transferred onto a recording medium P (e.g., a sheet) collectively in a secondary transfer process.

The photoconductive drums 20Y, 20C, 20M, and 20K are surrounded by various devices used to form the yellow, cyan, magenta, and black toner images on the photoconductive drums 20Y, 20C, 20M, and 20K rotating clockwise in FIG. 1 in a rotation direction R2. Taking the photoconductive drum 20K used to form a black toner image as an example, the photoconductive drum 20K is surrounded by a charger 30K, a development device 40K, a primary transfer roller 12K serving as a primary transferor, and a cleaner 50K incorporating a cleaning blade, which are arranged in the rotation direction R2 of the photoconductive drum 20K. For example, the photoconductive drum 20K is a tube having a surface photoconductive layer including an inorganic or organic photoreceptor. The charger 30K, disposed in close proximity to the photoconductive drum 20K, charges the photoconductive drum 20K by electric discharge therebetween. After the charger 30K charges an outer circumferential surface of the photoconductive drum 20K, an optical writer 8, serving as an exposure device or an electrostatic latent image formation device, exposes the charged outer circumferential surface of the photoconductive drum 20K, writing an electrostatic latent image thereon.

For example, the optical writer 8 is constructed of a semiconductor laser serving as a light source, a coupling lens, an f-θ lens, a troidal lens, reflection mirrors, and a rotatable polygon mirror serving as an optical deflector. The optical writer 8 emits laser beams Lb onto the outer circumferential surface of the respective photoconductive drums 20Y, 20C, 20M, and 20K according to image data sent from an external device such as a client computer, thus forming electrostatic latent images on the photoconductive drums 20Y, 20C, 20M, and 20K, respectively.

Each of the development devices 40Y, 40C, 40M, and 40K, detachably attached to the image forming devices 2Y, 2C, 2M, and 2K, is constructed of a toner supply portion and a development portion. The toner supply portion supplies toner to the development portion that supplies the toner to the electrostatic latent image formed on the respective photoconductive drums 20Y, 20C, 20M, and 20K.

As the intermediate transfer belt 11 rotates in the rotation direction R1, the yellow, cyan, magenta, and black toner images formed on the photoconductive drums 20Y, 20C, 20M, and 20K are primarily transferred onto the intermediate transfer belt 11 in such a manner that the yellow, cyan, magenta, and black toner images are superimposed on the same position on the intermediate transfer belt 11. For example, the photoconductive drums 20Y, 20C, 20M, and 20K are disposed opposite primary transfer rollers 12Y, 12C, 12M, and 12K, serving as primary transferors, respectively, via the intermediate transfer belt 11. As a primary transfer bias is applied to the primary transfer rollers 12Y, 12C, 12M, and 12K, the yellow, cyan, magenta, and black toner images formed on the photoconductive drums 20Y, 20C, 20M, and 20K are primarily transferred onto the intermediate transfer belt 11 successively at different times from the upstream photoconductive drum 20Y to the downstream photoconductive drum 20K in the rotation direction R1 of the intermediate transfer belt 11.

The primary transfer rollers 12Y, 12C, 12M, and 12K sandwich the intermediate transfer belt 11 together with the photoconductive drums 20Y, 20C, 20M, and 20K, forming primary transfer nips between the intermediate transfer belt 11 and the photoconductive drums 20Y, 20C, 20M, and 20K. A power supply connected to the primary transfer rollers 12Y, 12C, 12M, and 12K applies a primary transfer bias, that is, a predetermined direct current voltage and/or an alternating current voltage, to the primary transfer rollers 12Y, 12C, 12M, and 12K.

After the primary transfer of the yellow, cyan, magenta, and black toner images from the photoconductive drums 20Y, 20C, 20M, and 20K, the cleaners 50Y, 50C, 50M, and 50K, each of which is constructed of an elastic rubber band and a toner removal brush, remove residual toner failed to be transferred onto the intermediate transfer belt 11 therefrom.

The photoconductive drums 20Y, 20C, 20M, and 20K are aligned in this order in the rotation direction R1 of the intermediate transfer belt 11. As described above, the photoconductive drums 20Y, 20C, 20M, and 20K are incorporated in the four image forming devices 2Y, 2C, 2M, and 2K that form yellow, cyan, magenta, and black toner images, respectively.

Above the photoconductive drums 20Y, 20C, 20M, and 20K are a transfer belt unit 10, a secondary transfer roller 5 serving as a secondary transferor, and a transfer belt cleaner 13. Below the photoconductive drums 20Y, 20C, 20M, and 20K is the optical writer 8 described above.

In addition to the endless intermediate transfer belt 11 and the plurality of primary transfer rollers 12Y, 12C, 12M, and 12K, the transfer belt unit 10 further includes a driving roller 72 and a driven roller 73 that support the intermediate transfer belt 11 looped thereover. As a driver drives and rotates the driving roller 72 counterclockwise in FIG. 1, the driving roller 72 rotates the intermediate transfer belt 11 in the rotation direction R1 by friction therebetween. The driving roller 72 also serves as a secondary transfer backup roller disposed opposite the secondary transfer roller 5 via the intermediate transfer belt 11. Similarly, the driven roller 73 also serves as a cleaning backup roller disposed opposite the belt cleaner 13 via the intermediate transfer belt 11. The driven roller 73 is attached with a biasing member such as a spring that presses the driven roller 73 against the belt cleaner 13 via the intermediate transfer belt 11. Thus, the driven roller 73 also stretches the intermediate transfer belt 11. The transfer belt unit 10, the primary transfer rollers 12Y, 12C, 12M, and 12K, the secondary transfer roller 5, and the belt cleaner 13 constitute a transfer device 71.

The secondary transfer roller 5 contacting the intermediate transfer belt 11 rotates in accordance with rotation of the intermediate transfer belt 11 by friction therebetween. The secondary transfer roller 5 sandwiches the intermediate transfer belt 11 together with the driving roller 72 to form a secondary transfer nip between the secondary transfer roller 5 and the intermediate transfer belt 11. Similar to the primary transfer rollers 12Y, 12C, 12M, and 12K, the secondary transfer roller 5 is connected to the power supply that applies a secondary transfer bias, that is, a predetermined direct current voltage and/or alternating current voltage thereto.

The belt cleaner 13, interposed between the secondary transfer nip and the image forming device 2Y in the rotation direction R1 of the intermediate transfer belt 11, is disposed opposite the driven roller 73 via the intermediate transfer belt 11 and cleans an outer circumferential surface of the intermediate transfer belt 11. The belt cleaner 13 includes a cleaning brush and a cleaning blade that contact the outer circumferential surface of the intermediate transfer belt 11 to remove residual toner from the intermediate transfer belt 11. A waste toner conveyance tube extending from the belt cleaner 13 to an inlet of a waste toner container conveys waste toner collected from the intermediate transfer belt 11 by the belt cleaner 13 to the waste toner container.

Below the transfer device 71 are a paper tray 61, a registration roller pair 4, and a recording medium sensor. The paper tray 61 loads a plurality of recording media P. The registration roller pair 4 feeds a recording medium P sent from the paper tray 61 to the secondary transfer nip. The recording medium sensor detects a leading edge of the recording medium P. For example, the paper tray 61 is situated in a lower portion of the image forming apparatus 1000 and is attached with a feed roller 3 that picks up and feeds an uppermost recording medium P of the plurality of recording media P loaded in the paper tray 61. As the feed roller 3 is driven and rotated counterclockwise in FIG. 1, the feed roller 3 feeds the uppermost recording medium P toward the registration roller pair 4.

A conveyance path R extends from the feed roller 3 to an output roller pair 7 to convey the recording medium P picked up from the paper tray 61 onto an outside of the image forming apparatus 1000 through the secondary transfer nip. The conveyance path R is provided with the registration roller pair 4 situated upstream from the secondary transfer nip formed between the secondary transfer roller 5 and the intermediate transfer belt 11 in a recording medium conveyance direction A1 to feed the recording medium P to the secondary transfer nip. For example, the registration roller pair 4 feeds the recording medium P conveyed from the paper tray 61 to the secondary transfer nip at a proper time when the color toner image formed on the intermediate transfer belt 11 by the image forming station 1 as described above reaches the secondary transfer nip. Specifically, when a predetermined time elapses after the recording medium sensor, interposed between the feed roller 3 and the registration roller pair 4, detects the leading edge of the recording medium P conveyed from the feed roller 3, the recording medium P is temporarily halted by the registration roller pair 4 as it strikes the registration roller pair 4. Then, the registration roller pair 4 resumes its rotation at a predetermined time to feed the recording medium P to the secondary transfer nip, for example, at a time when the color toner image formed on the intermediate transfer belt 11 reaches the secondary transfer nip.

The recording media P may be thick paper, postcards, envelopes, plain paper, thin paper, coated paper, art paper, tracing paper, OHP (overhead projector) transparencies, recording sheets, and the like. In addition to the paper tray 61, the image forming apparatus 1000 may be equipped with a bypass tray that loads thick paper, postcards, envelopes, thin paper, tracing paper, OHP transparencies, and the like.

Downstream from the secondary transfer nip in the recording medium conveyance direction A1 are a fixing device 100, the output roller pair 7, and an output tray 17. The fixing device 100 fixes the color toner image transferred from the intermediate transfer belt 11 onto the recording medium P thereon. The output roller pair 7 discharges the recording medium P bearing the fixed color toner image onto the outside of the image forming apparatus 1000, that is, the output tray 17. The output tray 17, disposed atop the image forming apparatus 1000, stocks the recording medium P discharged by the output roller pair 7.

A plurality of toner bottles 9Y, 9C, 9M, and 9K containing yellow, cyan, magenta, and black toners is detachably attached to a plurality of toner bottle holders, respectively, disposed in an upper portion of the image forming apparatus 1000 situated below the output tray 17. A toner supply tube is interposed between the toner bottles 9Y, 9C, 9M, and 9K and the development devices 40Y, 40C, 40M, and 40K, respectively, thus supplying the yellow, cyan, magenta, and black toners from the toner bottles 9Y, 9C, 9M, and 9K to the development devices 40Y, 40C, 40M, and 40K.

As described above, the belt cleaner 13 of the transfer device 71 includes the cleaning brush and the cleaning blade that contact the outer circumferential surface of the intermediate transfer belt 11. The cleaning brush and the cleaning blade scrape and remove a foreign substance such as residual toner off the intermediate transfer belt 11, thus cleaning the intermediate transfer belt 11. The belt cleaner 13 includes a waste toner discharger that discharges the residual toner collected from the intermediate transfer belt 11 into the waste toner conveyance tube described above.

With reference to FIG. 1, a description is provided of an image forming operation of the image forming apparatus 1000 having the structure described above to form a color toner image on a recording medium P.

As a print job starts, a driver drives and rotates the photoconductive drums 20Y, 20C, 20M, and 20K of the image forming devices 2Y, 2C, 2M, and 2K, respectively, clockwise in FIG. 1 in the rotation direction R2. The chargers 30Y, 30C, 30M, and 30K uniformly charge the outer circumferential surface of the respective photoconductive drums 20Y, 20C, 20M, and 20K at a predetermined polarity. The optical writer 8 emits laser beams Lb onto the charged outer circumferential surface of the respective photoconductive drums 20Y, 20C, 20M, and 20K according to yellow, cyan, magenta, and black image data contained in image data sent from the external device, respectively, thus forming electrostatic latent images thereon. The development devices 40Y, 40C, 40M, and 40K supply yellow, cyan, magenta, and black toners to the electrostatic latent images formed on the photoconductive drums 20Y, 20C, 20M, and 20K, visualizing the electrostatic latent images into yellow, cyan, magenta, and black toner images, respectively.

Simultaneously, as the print job starts, the driving roller 72 is driven and rotated counterclockwise in FIG. 1, rotating the intermediate transfer belt 11 in the rotation direction R1 by friction therebetween. A power supply applies a constant voltage or a constant current control voltage having a polarity opposite a polarity of the toner to the primary transfer rollers 12Y, 12C, 12M, and 12K. Thus, a predetermined transfer electric field is created at the primary transfer nips formed between the primary transfer rollers 12Y, 12C, 12M, and 12K and the photoconductive drums 20Y, 20C, 20M, and 20K, respectively.

When the yellow, cyan, magenta, and black toner images formed on the photoconductive drums 20Y, 20C, 20M, and 20K reach the primary transfer nips, respectively, in accordance with rotation of the photoconductive drums 20Y, 20C, 20M, and 20K, the yellow, cyan, magenta, and black toner images are primarily transferred from the photoconductive drums 20Y, 20C, 20M, and 20K onto the intermediate transfer belt 11 by the transfer electric field created at the primary transfer nips in such a manner that the yellow, cyan, magenta, and black toner images are superimposed successively on a same position on the intermediate transfer belt 11. Thus, a color toner image is formed on the intermediate transfer belt 11. After the primary transfer of the yellow, cyan, magenta, and black toner images from the photoconductive drums 20Y, 20C, 20M, and 20K onto the intermediate transfer belt 11, the cleaners 50Y, 50C, 50M, and 50K remove residual toner failed to be transferred onto the intermediate transfer belt 11 and therefore remaining on the photoconductive drums 20Y, 20C, 20M, and 20K therefrom. Thereafter, dischargers discharge the outer circumferential surface of the respective photoconductive drums 20Y, 20C, 20M, and 20K, initializing the surface potential thereof for a next image forming operation.

On the other hand, the feed roller 3 disposed in the lower portion of the image forming apparatus 1000 is driven and rotated to feed a recording medium P from the paper tray 61 toward the registration roller pair 4 in the conveyance path R. The registration roller pair 4 feeds the recording medium P to the secondary transfer nip formed between the secondary transfer roller 5 and the intermediate transfer belt 11 at a time when the color toner image formed on the intermediate transfer belt 11 reaches the secondary transfer nip. The secondary transfer roller 5 is applied with a transfer voltage having a polarity opposite a polarity of the charged yellow, cyan, magenta, and black toners constituting the color toner image formed on the intermediate transfer belt 11, thus creating a predetermined transfer electric field at the secondary transfer nip.

When the color toner image formed on the intermediate transfer belt 11 reaches the secondary transfer nip in accordance with rotation of the intermediate transfer belt 11, the color toner image is secondarily transferred from the intermediate transfer belt 11 onto the recording medium P by the transfer electric field created at the secondary transfer nip. After the secondary transfer of the color toner image from the intermediate transfer belt 11 onto the recording medium P, the belt cleaner 13 removes residual toner failed to be transferred onto the recording medium P and therefore remaining on the intermediate transfer belt 11 therefrom. The removed toner is conveyed and collected into the waste toner container.

Thereafter, the recording medium P bearing the color toner image is conveyed to the fixing device 100 where the color toner image is fixed on the recording medium P. Then, the recording medium P bearing the fixed color toner image is discharged by the output roller pair 7 onto the output tray 17.

The above describes the image forming operation of the image forming apparatus 1000 to form the color toner image on the recording medium P. Alternatively, the image forming apparatus 1000 may form a monochrome toner image by using any one of the four image forming devices 2Y, 2C, 2M, and 2K or may form a bicolor or tricolor toner image by using two or three of the image forming devices 2Y, 2C, 2M, and 2K.

Figure 2:
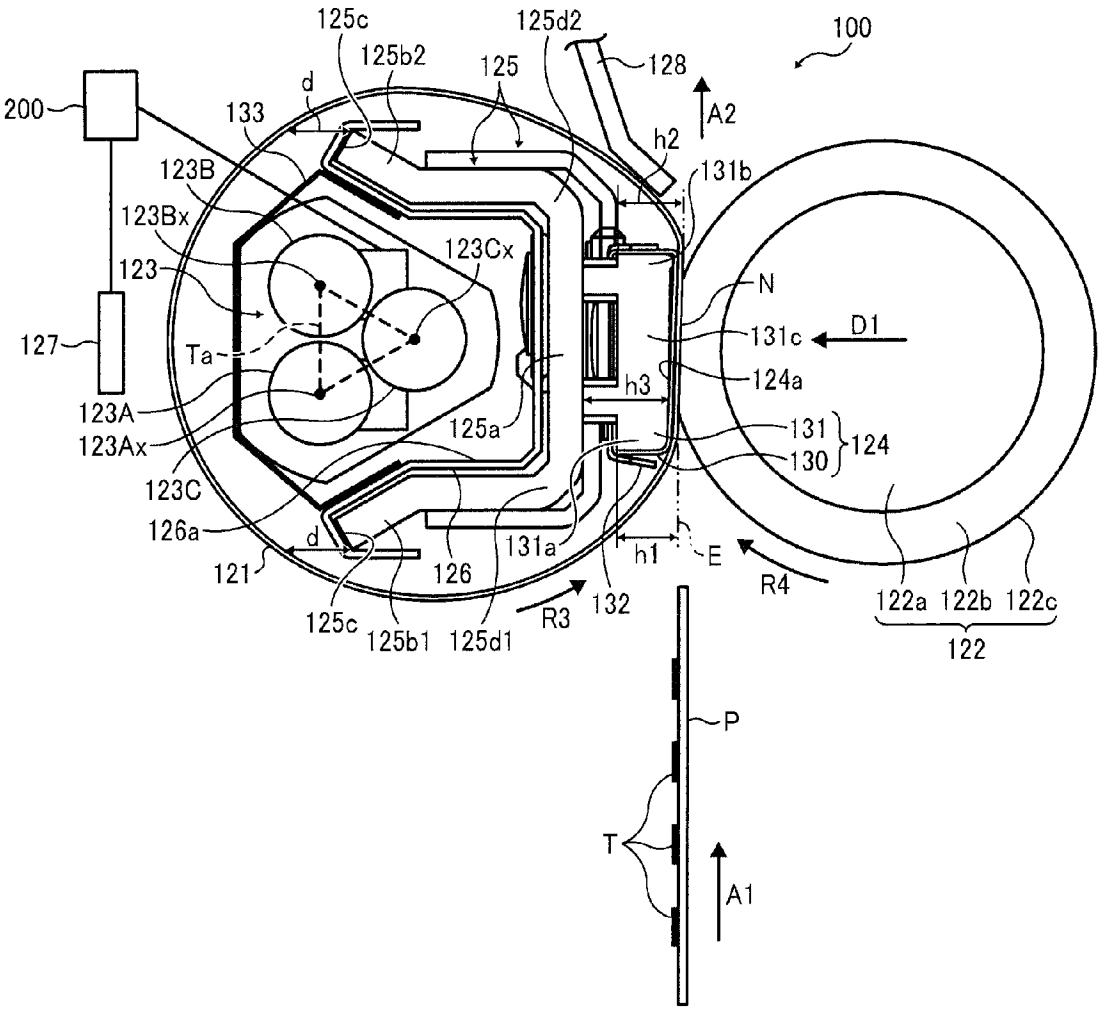
FIG. 2 is a vertical sectional view of a fixing device according to a first exemplary embodiment of the present invention that is incorporated in the image forming apparatus shown in FIG. 1.

With reference to FIG. 2, a description is provided of a construction of the fixing device 100 incorporated in the image forming apparatus 1000 described above.

FIG. 2 is a vertical sectional view of the fixing device 100 according to a first exemplary embodiment. As shown in FIG. 2, the fixing device 100 (e.g., a fuser) includes a fixing belt 121 serving as an endless rotary body, a heating rotary body, or a fixing rotary body, that is, an endless belt formed into a loop and rotatable in a rotation direction R3; a pressing roller 122 serving as a pressing body or an opposed rotary body disposed opposite an outer circumferential surface of the fixing belt 121 to form a fixing nip N therebetween and rotatable in a rotation direction R4 counter to the rotation direction R3 of the fixing belt 121; and a halogen heater set 123 serving as a heater disposed inside the loop formed by the fixing belt 121 and heating the fixing belt 121.

A detailed description is now given of a construction of the halogen heater set 123.

The halogen heater set 123 radiates light, that is, radiation heat, to the fixing belt 121, thus heating the fixing belt 121 directly. The halogen heater set 123 includes three halogen heaters 123A, 123B, and 123C disposed inside the loop formed by the fixing belt 121 such that they are disposed opposite an inner circumferential surface of the fixing belt 121. The halogen heaters 123A, 123B, and 123C serve as heaters or heat sources that have three different heating regions thereof in an axial direction of the fixing belt 121 that generate heat, respectively. Accordingly, the three halogen heaters 123A, 123B, and 123C heat the fixing belt 121 in three different regions on the fixing belt 121, respectively, in the axial direction thereof so that the fixing belt 121 heats recording media P of various widths in the axial direction of the fixing belt 121.

For example, the halogen heater 123A serves as a third heater or a center heater that heats a center of the fixing belt 121 in the axial direction thereof where a small recording medium P is conveyed. The center of the fixing belt 121 has a width in the axial direction thereof that is equivalent to a width of a letter size recording medium P in portrait orientation. The halogen heater 123B serves as a first heater or a first lateral end heater that heats each lateral end of the fixing belt 121 in the axial direction thereof where each lateral end of a medium recording medium P in the axial direction of the fixing belt 121 is conveyed. The medium recording medium P is a double letter size recording medium P having a width in portrait orientation greater than that of the letter size recording medium P in the axial direction of the fixing belt 121. The halogen heater 123C serves as a second heater or a second lateral end heater that heats each lateral end of the fixing belt 121 in the axial direction thereof where each lateral end of a large recording medium P in the axial direction of the fixing belt 121 is conveyed. The large recording medium P is an A3 size recording medium P having a width in portrait orientation greater than that of the double letter size recording medium P.

While a small recording medium P having a width in portrait orientation equivalent to or smaller than that of a letter size recording medium P, that is, a letter size recording medium P or smaller, is conveyed through the fixing nip N formed between the fixing belt 121 and the pressing roller 122, the halogen heater 123A is turned on but the halogen heaters 123B and 123C are turned off. While a medium recording medium P in portrait orientation, that is, a double letter size recording medium P, is conveyed through the fixing nip N, the halogen heaters 123A and 123B are turned on. While a large recording medium P in portrait orientation, that is, an A3 size recording medium P, is conveyed through the fixing nip N, the halogen heaters 123A and 123C are turned on.

As shown in FIG. 2, the halogen heaters 123A, 123B, and 123C are situated inside the loop formed by the fixing belt 121 in such a manner that three axes 123Ax, 123Bx, and 123Cx of the three halogen heaters 123A, 123B, and 123C constitute three vertices of a triangle Ta in cross-section, respectively. The halogen heater 123C is situated closer to a nip formation assembly 124 producing the fixing nip N than the halogen heaters 123A and 123B are. That is, the halogen heater 123C is interposed between the halogen heaters 123A and 123B and the nip formation assembly 124 in a diametrical direction of the fixing belt 121. This is because the fixing device 100 is designed for letter size recording media P and double letter size recording media P rather than for A3 size recording media P. Since letter size recording media P and double letter size recording media P are used more frequently than A3 size recording media P, the halogen heaters 123A and 123B configured to heat the letter size recording media P and the double letter size recording media P are disposed closer to the inner circumferential surface of the fixing belt 121 than the halogen heater 123C configured to heat the A3 size recording media P, thus heating the letter size recording media P and the double letter size recording media P through the fixing belt 121 efficiently.

It is to be noted that since the width of a double letter size recording medium P in portrait orientation is equivalent to the width of a letter size recording medium P in landscape orientation in the axial direction of the fixing belt 121 orthogonal to the recording medium conveyance direction A1, the halogen heaters 123A and 123B are turned on to heat the letter size recording medium P in landscape orientation. Similarly, since the width of an A3 size recording medium P in portrait orientation is equivalent to the width of an A4 size recording medium P in landscape orientation in the axial direction of the fixing belt 121, the halogen heaters 123A and 123C are turned on to heat the A4 size recording medium P in landscape orientation.

The portrait orientation defines an orientation in which the long side of the recording medium P is parallel to the recording medium conveyance direction A1. Conversely, the landscape orientation defines an orientation in which the short side of the recording medium P is parallel to the recording medium conveyance direction A1.

As shown in FIG. 2, the fixing device 100 further includes the nip formation assembly 124 pressing against the pressing roller 122 via the fixing belt 121 to form the fixing nip N between the fixing belt 121 and the pressing roller 122; a metal plate 132 partially surrounding the nip formation assembly 124; a stay 125 serving as a support that supports the nip formation assembly 124 via the metal plate 132; and a reflector 126 that reflects light radiated from the halogen heater set 123 thereto toward the fixing belt 121.

The fixing device 100 further includes a temperature sensor 127 serving as a temperature detector disposed opposite the outer circumferential surface of the fixing belt 121 and detecting the temperature of the fixing belt 121; a separator 128 disposed opposite the outer circumferential surface of the fixing belt 121 and separating the recording medium P from the fixing belt 121; and a pressurization assembly that presses the pressing roller 122 against the nip formation assembly 124 via the fixing belt 121.

The fixing belt 121 is heated directly by light radiated from the halogen heater set 123 disposed opposite the inner circumferential surface of the fixing belt 121. The nip formation assembly 124 is disposed opposite the inner circumferential surface of the fixing belt 121. As the fixing belt 121 rotates in the rotation direction R3, the inner circumferential surface of the fixing belt 121 slides over the nip formation assembly 124.

As shown in FIG. 2, the nip formation assembly 124 has an opposed face 124*a* disposed opposite the fixing belt 121 at the fixing nip N and linearly extending in the recording medium conveyance direction A1 to produce the planar fixing nip N. Alternatively, the opposed face 124*a* of the nip formation assembly 124 may be concave with respect to the fixing belt 121 or have other shapes. If the concave opposed face 124*a* of the nip formation assembly 124 produces the concave fixing nip N, the concave fixing nip N directs a leading edge of a recording medium P toward the pressing roller 122 as the recording medium P is discharged from the fixing nip N, thus facilitating separation of the recording medium P from the fixing belt 121 and thereby minimizing jamming of the recording medium P.

A detailed description is now given of a construction of the fixing belt 121.

The fixing belt 121 is a thin, flexible endless belt or film. For example, the fixing belt 121 is constructed of a base layer constituting the inner circumferential surface of the fixing belt 121 and a release layer constituting the outer circumferential surface of the fixing belt 121. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. The release layer prevents adhesion of toner from the recording medium P to the fixing belt 121. Alternatively, an elastic layer, made of rubber such as silicone rubber, silicone rubber foam, and fluoro rubber, may be interposed between the base layer and the release layer. As the fixing belt 121 and the pressing roller 122 exert pressure to a toner image T on a recording medium P, the elastic layer of the pressing roller 122 prevents slight surface asperities of the fixing belt 121 from being transferred onto the toner image T on the recording medium P, thus minimizing variation in gloss of the solid toner image T, that is, minimizing formation of an orange peel image. It is preferable that the elastic layer of the pressing roller 122 has a thickness not smaller than about 100 micrometers, for example, to prevent formation of an orange peel image effectively. As the elastic layer of the pressing roller 122 is deformed by pressure between the pressing roller 122 and the fixing belt 121, the elastic layer absorbs slight surface asperities of the fixing belt 121, preventing formation of an orange peel image.

A detailed description is now given of a construction of the pressing roller 122.

The pressing roller 122 is constructed of a metal core 122*a*; an elastic layer 122*b* coating the metal core 122*a* and made of silicone rubber foam, silicone rubber, fluoro rubber, or the like; and a release layer 122*c* coating the elastic layer 122*b* and made of PFA, PTFE, or the like. The pressurization assembly including a spring presses the pressing roller 122 against the nip formation assembly 124 via the fixing belt 121. Thus, the pressing roller 122 pressingly contacting the fixing belt 121 deforms the elastic layer 122*b* of the pressing roller 122 at the fixing nip N formed between the pressing roller 122 and the fixing belt 121, thus creating the fixing nip N having a predetermined length in the recording medium conveyance direction A1.

A driver (e.g., a motor) disposed inside the image forming apparatus 1000 depicted in FIG. 1 drives and rotates the pressing roller 122 through a gear train. As the driver drives and rotates the pressing roller 122, a driving force of the driver is transmitted from the pressing roller 122 to the fixing belt 121 at the fixing nip N, thus rotating the fixing belt 121 by friction between the pressing roller 122 and the fixing belt 121.

The fixing belt 121 rotates in accordance with rotation of the pressing roller 122. For example, as described above, as the driver such as the motor drives and rotates the pressing roller 122 in the rotation direction R4, a driving force of the driver is transmitted from the pressing roller 122 to the fixing belt 121 at the fixing nip N, thus rotating the fixing belt 121 by friction between the pressing roller 122 and the fixing belt 121. At the fixing nip N, the fixing belt 121 is nipped between the pressing roller 122 and the nip formation assembly 124 and is rotated by friction with the pressing roller 122. Conversely, at a position other than the fixing nip N, the fixing belt 121 is rotated while guided by a belt holder 140 described below at both lateral ends of the fixing belt 121 in the axial direction thereof.

According to this exemplary embodiment, the pressing roller 122 is a solid roller. Alternatively, the pressing roller 122 may be a hollow roller. In this case, a heater such as a halogen heater may be disposed inside the hollow roller. If the pressing roller 122 does not incorporate the elastic layer 122*b*, the pressing roller 122 has a decreased thermal capacity that improves fixing performance of being heated to a predetermined fixing temperature quickly. However, as the pressing roller 122 and the fixing belt 121 sandwich and press the toner image T on the recording medium P passing through the fixing nip N, slight surface asperities of the fixing belt 121 may be transferred onto the toner image T on the recording medium P, resulting in variation in gloss of the solid toner image T. To address this problem, it is preferable that the pressing roller 122 incorporates the elastic layer 122*b* having a thickness not smaller than about 100 micrometers. The elastic layer 122*b* having the thickness not smaller than about 100 micrometers elastically deforms to absorb slight surface asperities of the fixing belt 121, preventing variation in gloss of the toner image T on the recording medium P.

The elastic layer 122*b* of the pressing roller 122 is made of solid rubber. Alternatively, if no heater is disposed inside the pressing roller 122, the elastic layer 122*b* may be made of insulative rubber, such as sponge rubber. The insulative rubber such as sponge rubber is more preferable than the solid rubber because it has an increased insulation that draws less heat from the fixing belt 121. According to this exemplary embodiment, the pressing roller 122 is pressed against the fixing belt 121. Alternatively, the pressing roller 122 may merely contact the fixing belt 121 with no pressure therebetween.

A detailed description is now given of a configuration of the halogen heater set 123.

Both lateral ends of the halogen heater set 123 in a longitudinal direction thereof parallel to the axial direction of the fixing belt 121 are mounted on side plates of the fixing device 100, respectively. A power supply situated inside the image forming apparatus 1000 supplies power to the halogen heater set 123 so that the halogen heater set 123 heats the fixing belt 121. A controller 200, that is, a central processing unit (CPU), provided with a random-access memory (RAM) and a read-only memory (ROM), for example, operatively connected to the halogen heater set 123 and the temperature sensor 127 controls the halogen heater set 123, that is, turns on and off the halogen heater set 123 or adjusts an amount of power supplied to the halogen heater set 123 based on the temperature of the fixing belt 121 detected by the temperature sensor 127 so as to adjust the temperature of the fixing belt 121 to a desired fixing temperature. Alternatively, an induction heater, a resistance heat generator, a carbon heater, or the like may be employed as a heater to heat the fixing belt 121 instead of the halogen heater set 123.

A detailed description is now given of a construction of the nip formation assembly 124.

The nip formation assembly 124 includes a base pad 131 and a slide sheet 130 (e.g., a low friction sheet) covering an outer surface of the base pad 131. A longitudinal direction of the base pad 131 in which it extends is parallel to the axial direction of the fixing belt 121 or the pressing roller 122. The base pad 131 receives pressure from the pressing roller 122 to define the shape of the fixing nip N.

The base pad 131 of the nip formation assembly 124 is mounted on and supported by the stay 125. Accordingly, even if the base pad 131 receives pressure from the pressing roller 122, the base pad 131 is not bent by the pressure and therefore produces a uniform nip width throughout the entire width of the pressing roller 122 in the axial direction thereof. The base pad 131 is made of a heat-resistant material having heat resistance against temperatures up to about 200 degrees centigrade. Accordingly, even if the base pad 131 is heated to a predetermined fixing temperature range, the base pad 131 is not thermally deformed, thus retaining the desired shape of the fixing nip N stably and thereby maintaining the quality of the fixed toner image T on the recording medium P. For example, the base pad 131 is made of general heat-resistant resin such as polyether sulfone (PES), polyphenylene sulfide (PPS), liquid crystal polymer (LCP), polyether nitrile (PEN), polyamide imide (PAI), polyether ether ketone (PEEK), or the like.

The slide sheet 130 is interposed at least between the base pad 131 and the fixing belt 121. For example, the slide sheet 130 covers at least the opposed face 124*a* of the base pad 131 disposed opposite the fixing belt 121 at the fixing nip N. As the fixing belt 121 rotates in the rotation direction R3, it slides over the slide sheet 130, decreasing a driving torque exerted on the fixing belt 121. Accordingly, a decreased friction is imposed onto the fixing belt 121 from the nip formation assembly 124. According to this exemplary embodiment, the fixing belt 121 slides over the base pad 131 indirectly via the slide sheet 130. Alternatively, the nip formation assembly 124 may not incorporate the slide sheet 130 so that the fixing belt 121 slides over the base pad 131 directly.

The stay 125 is made of metal having an increased mechanical strength, such as stainless steel and iron, to support the nip formation assembly 124 against pressure from the pressing roller 122, preventing bending of the nip formation assembly 124. The base pad 131 is also made of a rigid material having an increased mechanical strength. For example, the base pad 131 is made of resin such as LCP, metal, ceramic, or the like.

A detailed description is now given of a configuration of the reflector 126.

The reflector 126 is interposed between the stay 125 and the halogen heater set 123. According to this exemplary embodiment, the reflector 126 is mounted on the stay 125. For example, the reflector 126 is made of aluminum, stainless steel, or the like. The reflector 126 has a reflection face 126*a* that reflects light, that is, radiation heat, radiated from the halogen heater set 123 thereto toward the fixing belt 121. Accordingly, the fixing belt 121 receives an increased amount of light from the halogen heater set 123 and thereby is heated efficiently. Additionally, the reflector 126 minimizes transmission of light from the halogen heater set 123 to the stay 125, thus minimizing energy wasted in unnecessarily heating the stay 125 by light from the halogen heater set 123 and thereby saving energy. Instead of mounting the reflector 126, a surface of the stay 125 may be treated with insulation or mirror finished to attain the advantages described above.

The fixing device 100 according to this exemplary embodiment attains various improvements to save more energy and shorten a first print time taken to output a recording medium P bearing a fixed toner image T onto the outside of the image forming apparatus 1000 depicted in FIG. 1 after the image forming apparatus 1000 receives a print job. As a first improvement, the fixing device 100 employs a direct heating method in which the halogen heater set 123 directly heats the fixing belt 121 at a portion thereof other than a nip portion thereof facing the fixing nip N. For example, as shown in FIG. 2, no component is interposed between the halogen heater set 123 and the fixing belt 121 at an outward portion of the fixing belt 121 disposed opposite the temperature sensor 127.

Accordingly, light from the halogen heater set 123 is directly transmitted to the fixing belt 121 at the outward portion thereof.

As a second improvement, the fixing belt 121 is designed to be thin and have a reduced loop diameter so as to decrease the thermal capacity thereof. For example, the fixing belt 121 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 121 has a total thickness not greater than about 1 mm. The loop diameter of the fixing belt 121 is in a range of from about 20 mm to about 40 mm. In order to decrease the thermal capacity of the fixing belt 121 further, the fixing belt 121 may have a total thickness not greater than about 0.20 mm, preferably not greater than about 0.16 mm. Additionally, the loop diameter of the fixing belt 121 may be not greater than about 30 mm.

According to this exemplary embodiment, the pressing roller 122 has a diameter in a range of from about 20 mm to about 40 mm so that the loop diameter of the fixing belt 121 is equivalent to the diameter of the pressing roller 122. However, the loop diameter of the fixing belt 121 and the diameter of the pressing roller 122 are not limited to the above. For example, the loop diameter of the fixing belt 121 may be smaller than the diameter of the pressing roller 122. In this case, a curvature of the fixing belt 121 at the fixing nip N is greater than that of the pressing roller 122, facilitating separation of the recording medium P discharged from the fixing nip N from the fixing belt 121.

Since the fixing belt 121 has a reduced loop diameter, space inside the loop formed by the fixing belt 121 is small. To address this circumstance, both ends of the stay 125 in the recording medium conveyance direction A1 are folded into a square bracket that accommodates the halogen heater set 123. Thus, the stay 125 and the halogen heater set 123 are placed in the small space inside the loop formed by the fixing belt 121.

Figure 3A:
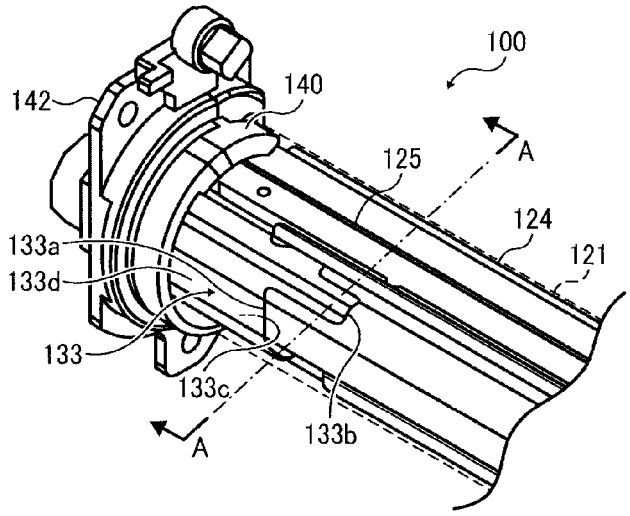
FIG. 3A is a partial perspective view of the fixing device shown in FIG. 2 illustrating one lateral end of a fixing belt incorporated therein in an axial direction thereof.
Figure 3B:
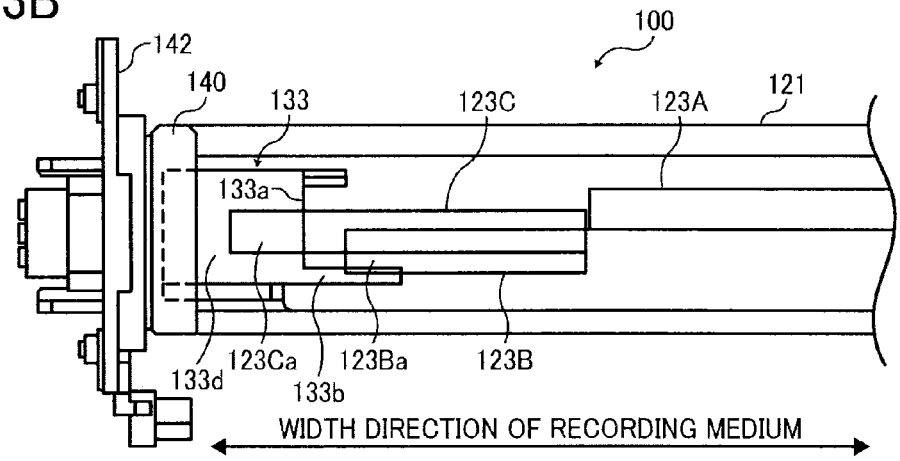
FIG. 3B is a partial plan view of the fixing device shown in FIG. 3A.
Figure 3C:
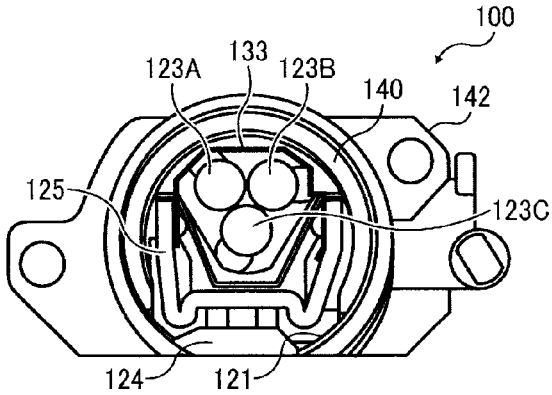
FIG. 3C is a vertical sectional view of the fixing device shown in FIG. 3A illustrating one lateral end of the fixing belt in the axial direction thereof.

With reference to FIGS. 3A, 3B, and 3C, a description is provided of a configuration of a lateral end of the fixing belt 121 in the axial direction thereof.

FIG. 3A is a partial perspective view of one lateral end of the fixing belt 121 in the axial direction thereof. FIG. 3B is a partial plan view of one lateral end of the fixing belt 121 in the axial direction thereof parallel to a width direction of a recording medium P. FIG. 3C is a vertical sectional view of one lateral end of the fixing belt 121 in the axial direction thereof. Although not shown, another lateral end of the fixing belt 121 in the axial direction thereof has the identical configuration shown in FIGS. 3A to 3C. Hence, the following describes the configuration of one lateral end of the fixing belt 121 in the axial direction thereof with reference to FIGS. 3A to 3C.

As shown in FIGS. 3A and 3B, the belt holder 140 is inserted into the loop formed by the fixing belt 121 at each lateral end of the fixing belt 121 in the axial direction thereof orthogonal to a circumferential direction thereof to rotatably support the fixing belt 121. As shown in FIG. 3C, the belt holder 140 is a flange that is C-shaped in cross-section to create an opening disposed opposite the fixing nip N where the nip formation assembly 124 is situated. As shown in FIG. 3A, the belt holder 140 is mounted on a side plate 142. Each lateral end of the stay 125 in a longitudinal direction thereof is also mounted on and positioned by the side plate 142. Like the stay 125, the side plate 142 is made of metal such as stainless steel and iron. Since the side plate 142 and the stay 125 are made of the common material, the stay 125 is mounted on the side plate 142 precisely.

As shown in FIG. 3B, a shield 133 (e.g., a shield plate) is situated at each lateral end of the fixing belt 121 in the axial direction thereof in such a manner that the shield 133 projects from the belt holder 140 to the halogen heaters 123B and 123C in the axial direction of the fixing belt 121. For example, the shield 133 overlaps an outboard lateral end 123Ca of the halogen heater 123C and an outboard lateral end 123Ba of the halogen heater 123B in the axial direction of the fixing belt 121. The shield 133 is interposed between the halogen heaters 123B and 123C and the fixing belt 121 and the belt holder 140, thus shielding the fixing belt 121 and the belt holder 140 from light, that is, radiation heat, emitted by the halogen heaters 123B and 123C. A detailed description of the shield 133 is deferred.

A slip ring is interposed between a lateral edge of the fixing belt 121 and an inward face of the belt holder 140 disposed opposite the lateral edge of the fixing belt 121 in the axial direction thereof. The slip ring serves as a protector that protects the lateral edge of the fixing belt 121 in the axial direction thereof. For example, even if the fixing belt 121 is skewed in the axial direction thereof, the slip ring prevents the lateral edge of the fixing belt 121 from coming into direct contact with the belt holder 140, thus minimizing abrasion and breakage of the lateral edge of the fixing belt 121 in the axial direction thereof. Since an inner diameter of the slip ring is sufficiently greater than an outer diameter of the belt holder 140, the slip ring loosely slips on the belt holder 140. Accordingly, when the lateral edge of the fixing belt 121 comes into contact with the slip ring, the slip ring is rotatable in accordance with rotation of the fixing belt 121 by friction therebetween. Alternatively, the slip ring may remain at rest irrespective of rotation of the fixing belt 121. The slip ring is made of heat-resistant, super engineering plastics such as PEEK, PPS, PAI, and PTFE.

With reference to FIG. 2, a detailed description is now given of a construction of the stay 125.

As shown in FIG. 2, in contrast to the stay 125, the nip formation assembly 124 is compact, thus allowing the stay 125 to extend as long as possible in the small space inside the loop formed by the fixing belt 121. For example, the length of the base pad 131 of the nip formation assembly 124 is smaller than that of the stay 125 in the recording medium conveyance direction A1. As shown in FIG. 2, the base pad 131 includes an upstream portion 131*a* disposed upstream from the fixing nip N in the recording medium conveyance direction A1; a downstream portion 131*b* disposed downstream from the fixing nip N in the recording medium conveyance direction A1; and a center portion 131*c* interposed between the upstream portion 131*a* and the downstream portion 131*b* in the recording medium conveyance direction A1. A height h1 defines a height of the upstream portion 131*a* from the fixing nip N or its hypothetical extension E in a pressurization direction D1 of the pressing roller 122 in which the pressing roller 122 is pressed against the nip formation assembly 124. A height h2 defines a height of the downstream portion 131*b* from the fixing nip N or its hypothetical extension E in the pressurization direction D1 of the pressing roller 122. A height h3, that is, a maximum height of the base pad 131, defines a height of the center portion 131*c* from the fixing nip N or its hypothetical extension E in the pressurization direction D1 of the pressing roller 122. The height h3 is not smaller than the height h1 and the height h2.

Hence, the upstream portion 131*a* of the base pad 131 of the nip formation assembly 124 is not interposed between the inner circumferential surface of the fixing belt 121 and an upstream curve 125*d*1 of the stay 125 in the diametrical direction of the fixing belt 121. Similarly, the downstream portion 131*b* of the base pad 131 of the nip formation assembly 124 is not interposed between the inner circumferential surface of the fixing belt 121 and a downstream curve 125*d*2 of the stay 125 in the diametrical direction of the fixing belt 121. Accordingly, the upstream curve 125*d*1 and the downstream curve 125*d*2 of the stay 125 are situated in proximity to the inner circumferential surface of the fixing belt 121. Consequently, the stay 125 having an increased size that enhances the mechanical strength thereof is accommodated in the limited space inside the loop formed by the fixing belt 121. As a result, the stay 125, with its enhanced mechanical strength, supports the nip formation assembly 124 properly, preventing bending of the nip formation assembly 124 caused by pressure from the pressing roller 122 and thereby improving fixing performance.

As shown in FIG. 2, the stay 125 includes a base 125*a* contacting the nip formation assembly 124 and an upstream arm 125*b*1 and a downstream arm 125*b*2, constituting a pair of projections, projecting from the base 125*a*. The base 125*a* extends in the recording medium conveyance direction A1, that is, a vertical direction in FIG. 2. The upstream arm 125*b*1 and the downstream arm 125*b*2 project from an upstream end and a downstream end of the base 125*a*, respectively, in the recording medium conveyance direction A1 and extend in the pressurization direction D1 of the pressing roller 122 orthogonal to the recording medium conveyance direction A1. The upstream arm 125*b*1 and the downstream arm 125*b*2 projecting from the base 125*a* in the pressurization direction D1 of the pressing roller 122 elongate a cross-sectional area of the stay 125 in the pressurization direction D1 of the pressing roller 122, increasing the section modulus and the mechanical strength of the stay 125.

Additionally, as the upstream arm 125*b*1 and the downstream arm 125*b*2 elongate further in the pressurization direction D1 of the pressing roller 122, the mechanical strength of the stay 125 becomes greater. Accordingly, it is preferable that a front edge 125*c* of each of the upstream arm 125*b*1 and the downstream arm 125*b*2 is situated as close as possible to the inner circumferential surface of the fixing belt 121 to allow the upstream arm 125*b*1 and the downstream arm 125*b*2 to project longer from the base 125*a* in the pressurization direction D1 of the pressing roller 122. However, since the fixing belt 121 swings or vibrates as it rotates, if the front edge 125*c* of each of the upstream arm 125*b*1 and the downstream arm 125*b*2 is excessively close to the inner circumferential surface of the fixing belt 121, the swinging or vibrating fixing belt 121 may come into contact with the upstream arm 125*b*1 or the downstream arm 125*b*2. For example, if the thin fixing belt 121 is used as in this exemplary embodiment, the thin fixing belt 121 swings or vibrates substantially. Accordingly, it is necessary to position the front edge 125*c* of each of the upstream arm 125*b*1 and the downstream arm 125*b*2 with respect to the fixing belt 121 carefully.

Specifically, as shown in FIG. 2, a distance d between the front edge 125*c* of each of the upstream arm 125*b*1 and the downstream arm 125*b*2 and the inner circumferential surface of the fixing belt 121 in the pressurization direction D1 of the pressing roller 122 is at least about 2.0 mm, preferably not smaller than about 3.0 mm. Conversely, if the fixing belt 121 is thick and therefore barely swings or vibrates, the distance d is about 0.02 mm. It is to be noted that if the reflector 126 is attached to the front edge 125*c* of each of the upstream arm 125*b*1 and the downstream arm 125*b*2 as in this exemplary embodiment, the distance d is determined by considering the thickness of the reflector 126 so that the reflector 126 does not contact the fixing belt 121.

The front edge 125*c* of each of the upstream arm 125*b*1 and the downstream arm 125*b*2 situated as close as possible to the inner circumferential surface of the fixing belt 121 allows the upstream arm 125*b*1 and the downstream arm 125*b*2 to project longer from the base 125*a* in the pressurization direction D1 of the pressing roller 122. Accordingly, even if the fixing belt 121 has a decreased loop diameter, the stay 125 having the longer upstream arm 125*b*1 and the longer downstream arm 125*b*2 attains an enhanced mechanical strength.

With reference to FIG. 2, a description is provided of a fixing operation of the fixing device 100 described above.

As the image forming apparatus 1000 depicted in FIG. 1 is powered on, the power supply supplies power to the halogen heater set 123 and at the same time the driver drives and rotates the pressing roller 122 clockwise in FIG. 2 in the rotation direction R4. Accordingly, the fixing belt 121 rotates counterclockwise in FIG. 2 in the rotation direction R3 in accordance with rotation of the pressing roller 122 by friction between the pressing roller 122 and the fixing belt 121.

A recording medium P bearing a toner image T formed by the image forming operation of the image forming apparatus 1000 described above is conveyed in the recording medium conveyance direction A1 while guided by a guide plate and enters the fixing nip N formed between the pressing roller 122 and the fixing belt 121 pressed by the pressing roller 122. The fixing belt 121 heated by the halogen heater set 123 heats the recording medium P and at the same time the pressing roller 122 pressed against the fixing belt 121 and the fixing belt 121 together exert pressure to the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge of the separator 128, the separator 128 separates the recording medium P from the fixing belt 121. Thereafter, the separated recording medium P is discharged by the output roller pair 7 depicted in FIG. 1 onto the outside of the image forming apparatus 1000, that is, the output tray 17 where the recording media P are stocked.

With reference to FIG. 2, a description is provided of advantages of the fixing device 100 having the configuration described above.

The nip formation assembly 124 guides the fixing belt 121 to the fixing nip N, minimizing vibration or swinging of the fixing belt 121 before the fixing belt 121 enters the fixing nip N and thereby facilitating stable and smooth entry of the fixing belt 121 into the fixing nip N. Accordingly, even if no guide other than the nip formation assembly 124 is configured to guide a center interposed between both lateral ends of the fixing belt 121 in the axial direction thereof to the fixing nip N, the nip formation assembly 124 guides and rotates the fixing belt 121 stably and smoothly. Consequently, the nip formation assembly 124 minimizes load imposed on the rotating fixing belt 121 and resultant wear of the fixing belt 121, preventing damage and breakage of the fixing belt 121 and enhancing reliability of the fixing device 100. For example, it is difficult for the fixing belt 121 having a reduced thickness that decreases the thermal capacity thereof to have an increased mechanical strength. However, the nip formation assembly 124 supports and guides the thin fixing belt 121, preventing damage and breakage of the fixing belt 121.

The nip formation assembly 124 incorporated in the fixing device 100 depicted in FIG. 2 guides the fixing belt 121 to the fixing nip N, resulting in the simple, compact fixing device 100 manufactured at reduced costs. Accordingly, the compact fixing device 100 has a reduced thermal capacity that shortens a warm-up time thereof, thus saving more energy and shortening a first print time taken to output a recording medium P bearing a toner image T onto the outside of the image forming apparatus 1000 after the image forming apparatus 1000 receives a print job.

Since the nip formation assembly 124 serves as a guide that guides the fixing belt 121 to the fixing nip N, it is not necessary to provide a guide separately from the nip formation assembly 124. Hence, no component is interposed between the inner circumferential surface of the fixing belt 121 and the upstream curve 125*d*1 of the stay 125 in the diametrical direction of the fixing belt 121. Similarly, no component is interposed between the inner circumferential surface of the fixing belt 121 and the downstream curve 125*d*2 of the stay 125 in the diametrical direction of the fixing belt 121. That is, the upstream curve 125*d*1 and the downstream curve 125*d*2 of the stay 125 are disposed opposite the inner circumferential surface of the fixing belt 121 directly. Accordingly, the upstream curve 125*d*1 and the downstream curve 125*d*2 of the stay 125 are situated in proximity to the inner circumferential surface of the fixing belt 121. Consequently, the stay 125 having an increased size that enhances the mechanical strength thereof is accommodated in the limited space inside the loop formed by the fixing belt 121. As a result, even if the fixing belt 121 is downsized to decrease its thermal capacity, the stay 125 accommodated inside the downsized fixing belt 121 achieves an enhanced mechanical strength that supports the nip formation assembly 124 properly, preventing bending of the nip formation assembly 124 caused by pressure from the pressing roller 122 and thereby improving fixing performance.

While the pressing roller 122 is isolated from the fixing belt 121, the nip formation assembly 124 is spaced apart from the inner circumferential surface of the fixing belt 121 so that the upstream portion 131*a* and the downstream portion 131*b* of the base pad 131 of the nip formation assembly 124 do not pressingly contact the fixing belt 121. Accordingly, the fixing belt 121 does not slide over the nip formation assembly 124, minimizing load imposed on the fixing belt 121 and resultant abrasion of the fixing belt 121. Additionally, the fixing belt 121 contacts the nip formation assembly 124 with a reduced friction therebetween, producing a desired path through which the fixing belt 21 enters the fixing nip N.

Figure 4:
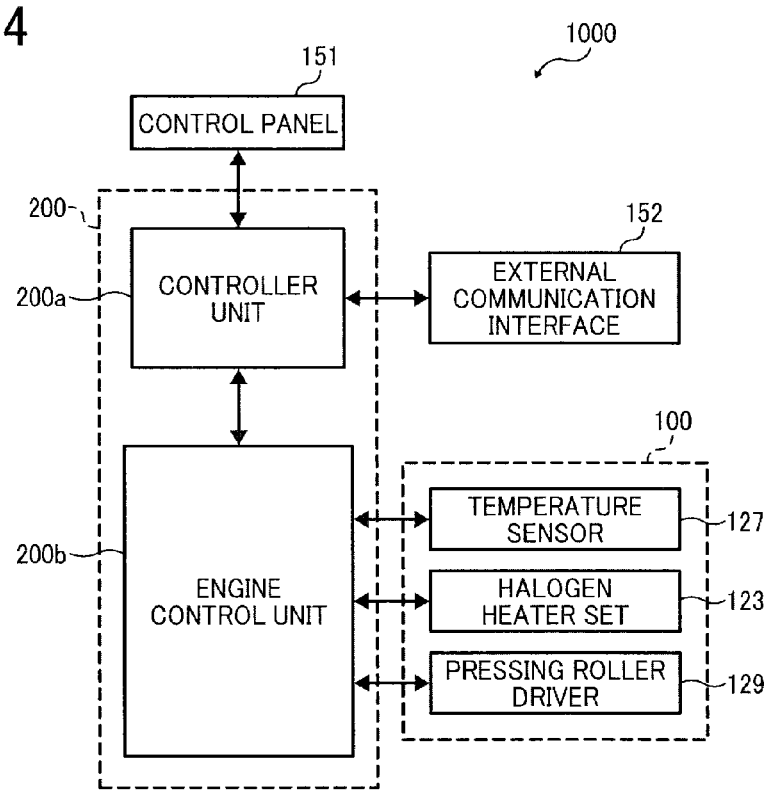
FIG. 4 is a block diagram of a controller incorporated in the image forming apparatus shown in FIG. 1.

With reference to FIG. 4, a description is provided of a control method for controlling the fixing device 100 incorporated in the image forming apparatus 1000 depicted in FIG. 1.

FIG. 4 is a block diagram of the controller 200 for controlling the fixing device 100. As shown in FIG. 4, the controller 200 includes a controller unit 200*a* and an engine control unit 200*b*. The controller unit 200*a* including the CPU, the ROM, and the RAM is operatively connected to the engine control unit 200*b*, a control panel 151, and an external communication interface 152. The controller unit 200*a*, by executing a preloaded control program, controls operation of the entire image forming apparatus 1000 and input from the external communication interface 152 and the control panel 151. For example, the controller unit 200*a* receives an instruction from a user input by using the control panel 151 disposed atop the image forming apparatus 1000 and performs various processes according to the instruction. Additionally, the controller unit 200*a* receives a print job, that is, an image forming job, and image data from an external client computer through the external communication interface 152 and controls the engine control unit 200*b*, thus controlling an image forming operation to form a toner image T, that is, a monochrome toner image T and a color toner image T, on a recording medium P and output the recording medium P bearing the toner image T.

The engine control unit 200*b* is operatively connected to the temperature sensor 127, the halogen heater set 123, and a pressing roller driver 129 incorporated in the fixing device 100. The engine control unit 200*b* including the CPU, the ROM, and the RAM, by executing a preloaded control program, controls a printer engine including the plurality of image forming devices 2Y, 2C, 2M, and 2K, the optical writer 8, and the fixing device 100 depicted in FIG. 1 that performs the image forming processes described above according to an instruction from the controller unit 200*a*. For example, the engine control unit 200*b*, in an image forming mode to form a toner image T on a recording medium P, controls power supply to the halogen heater set 123 to heat the fixing belt 121 to a predetermined target temperature based on the temperature of the fixing belt 121 detected by the temperature sensor 127 and controls the pressing roller driver 129 that drives and rotates the pressing roller 122.

The image forming apparatus 1000 has three modes: the image forming mode to perform the image forming processes described above; a standby mode to wait for an instruction to start the image forming processes; and a sleep mode to consume less power than the standby mode. For example, in the image forming mode, the fixing belt 121 of the fixing device 100 is warmed up to a predetermined fixing temperature in a range of from about 158 degrees centigrade to about 170 degrees centigrade, and then the fixing device 100 performs the fixing process for fixing the toner image T on the recording medium P. In the standby mode, the fixing belt 121 of the fixing device 100 is maintained at a predetermined lower temperature of about 90 degrees centigrade lower than the predetermined fixing temperature set in the image forming mode. In the sleep mode, power is not supplied to the engine control unit 200*b* and the printer engine including the fixing device 100, and thus the halogen heater set 123 and the pressing roller 122 are turned off.

Figure 5:
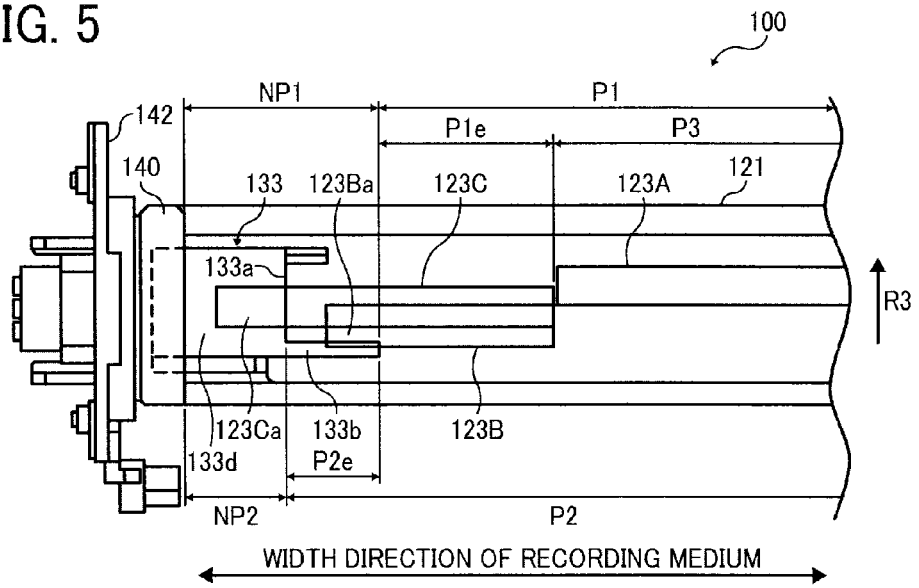
FIG. 5 is a partial plan view of one lateral end of the fixing belt in the axial direction thereof illustrating halogen heaters and a shield disposed opposite the fixing belt.

With reference to FIG. 5, a description is provided of a relation between the position of the halogen heaters 123A, 123B, and 123C and the shield 133 and a passage region and a non-passage region of the fixing belt 121 for recording media P of various sizes.

FIG. 5 is a partial plan view of one lateral end of the fixing belt 121 in the axial direction thereof illustrating the halogen heaters 123A, 123B, and 123C and the shield 133. As shown in FIG. 5, the halogen heater 123A is disposed opposite a passage region P3 of the fixing belt 121 where a letter size recording medium in portrait orientation passes. The halogen heaters 123A and 123B are disposed opposite a passage region P1 of the fixing belt 121 where a double letter size recording medium in portrait orientation passes. Specifically, the halogen heater 123B is disposed opposite a lateral end P1*e* of the passage region P1 of the fixing belt 121 where the double letter size recording medium passes. The halogen heaters 123A and 123C are disposed opposite a passage region P2 of the fixing belt 121 where an A3 size recording medium in portrait orientation passes.

As shown in FIG. 5, the outboard lateral end 123Ba of the halogen heater 123B in the axial direction of the fixing belt 121 parallel to the width direction of the recording medium P is disposed opposite a non-passage region NP1 of the fixing belt 121 where a double letter size recording medium in portrait orientation (hereinafter referred to as a double letter size recording medium DLT) does not pass. Accordingly, after a plurality of double letter size recording media DLT passes over the fixing belt 121 continuously while the halogen heater 123B is turned on, the non-passage region NP1 of the fixing belt 121 may overheat because the plurality of double letter size recording media DLT does not pass over the non-passage region NP1 of the fixing belt 121 and therefore does not draw heat therefrom. To address this problem, the shield 133 shields the non-passage region NP1 of the fixing belt 121 from light radiated from the halogen heater 123B, thus decreasing an amount of light radiated from the halogen heater 123B that reaches the non-passage region NP1 of the fixing belt 121.

Similarly, the outboard lateral end 123Ca of the halogen heater 123C in the axial direction of the fixing belt 121 is disposed opposite a non-passage region NP2 of the fixing belt 121 where an A3 size recording medium in portrait orientation (hereinafter referred to as an A3 size recording medium A3T) does not pass. Accordingly, after a plurality of A3 size recording media A3T passes over the fixing belt 121 continuously while the halogen heater 123C is turned on, the non-passage region NP2 of the fixing belt 121 may overheat because the plurality of A3 size recording media A3T does not pass over the non-passage region NP2 of the fixing belt 121 and therefore does not draw heat therefrom. To address this problem, the shield 133 shields the non-passage region NP2 of the fixing belt 121 from light radiated from the halogen heater 123C, thus decreasing an amount of light radiated from the halogen heater 123C that reaches the non-passage region NP2 of the fixing belt 121.

Hence, the shield 133 shields the non-passage regions NP1 and NP2 of the fixing belt 121 from light radiated from the halogen heaters 123B and 123C, minimizing overheating of the non-passage regions NP1 and NP2 of the fixing belt 121 after the plurality of double letter size recording media DLT and the plurality of A3 size recording media A3T continuously pass over the fixing belt 121, respectively, and thereby preventing wear and damage of the fixing belt 121 caused by heat from the halogen heaters 123B and 123C.

The shield 133 is made of a heat-resistant material having resistance against temperatures up to about 400 degrees centigrade. According to this exemplary embodiment, the shield 133 is a metal sheet made of SUS stainless steel and having a thickness of about 0.5 mm. Thus, even if the shield 133 is heated by light from the halogen heaters 123B and 123C, the heat-resistant shield 133 minimizes its wear that may arise due to overheating.

An opposed face 133*c* depicted in FIG. 3A of the shield 133 disposed opposite the halogen heaters 123B and 123C has an overall reflectance not greater than about 80 percent, preventing light reflected by the opposed face 133*c* of the shield 133 from heating components located in proximity to the shield 133 and thereby minimizing thermal wear of these components.

As shown in FIG. 3A, the shield 133 is in contact with the stay 125. Accordingly, heat received from the halogen heaters 123B and 123C is conducted from the shield 133 to the stay 125, minimizing temperature increase of the shield 133 and thereby preventing overheating and resultant thermal wear of the shield 133. Additionally, the shield 133 shields the belt holder 140 from light radiated from the halogen heaters 123B and 123C, minimizing thermal wear of the belt holder 140.

If the shield 133 shields the entire outboard lateral end 123Ba of the halogen heater 123B disposed opposite the non-passage region NP1 of the fixing belt 121 depicted in FIG. 5, the shield 133 prevents almost all of light radiated from the halogen heater 123B from reaching the non-passage region NP1 of the fixing belt 121 while the double letter size recording medium DLT passes over the fixing belt 121. However, if the shield 133 is configured to shield the entire outboard lateral end 123Ba of the halogen heater 123B, during passage of the double letter size recording medium DLT, the shield 133 may also prevent light radiated from the halogen heater 123C from reaching the fixing belt 121 unnecessarily. Accordingly, such shield 133 may unnecessarily restrict heating of an area on the fixing belt 121 that need to be heated by the halogen heater 123C. For example, a lateral end P2*e* of the passage region P2 of the fixing belt 121 in the axial direction thereof where the A3 size recording medium A3T passes may not be heated by the halogen heater 123C to the predetermined fixing temperature, resulting in fixing failure.

To address this problem, the shield 133 has a shape that reduces overheating of the non-passage region NP1 of the double letter size recording medium DLT and the non-passage region NP2 of the A3 size recording medium A3T and at the same time minimizes fixing failure at the lateral end P2*e* of the passage region P2 where the A3 size recording medium A3T passes that may arise due to insufficient heating. For example, as shown in FIG. 5, the shield 133 is produced with a rectangular notch 133*a* disposed opposite the lateral end P2*e* of the passage region P2 of the fixing belt 121 where the A3 size recording medium A3T passes. Specifically, at the lateral end P2*e* of the passage region P2 of the fixing belt 121, the non-passage region NP1 of the fixing belt 121 where the double letter size recording medium DLT does not pass overlaps the passage region P2 of the fixing belt 121 where the A3 size recording medium A3T passes in the axial direction of the fixing belt 121.

Figure 6A:
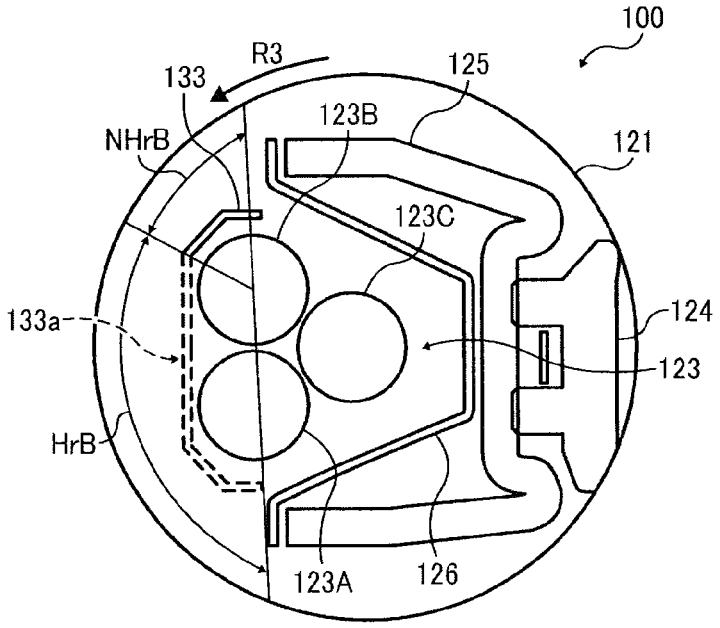
FIG. 6A is a partial vertical sectional view of the fixing device shown in FIG. 2 taken on the line A-A of FIG. 3A illustrating a heated region of the fixing belt heated by one of the halogen heaters shown in FIG. 5.
Figure 6B:
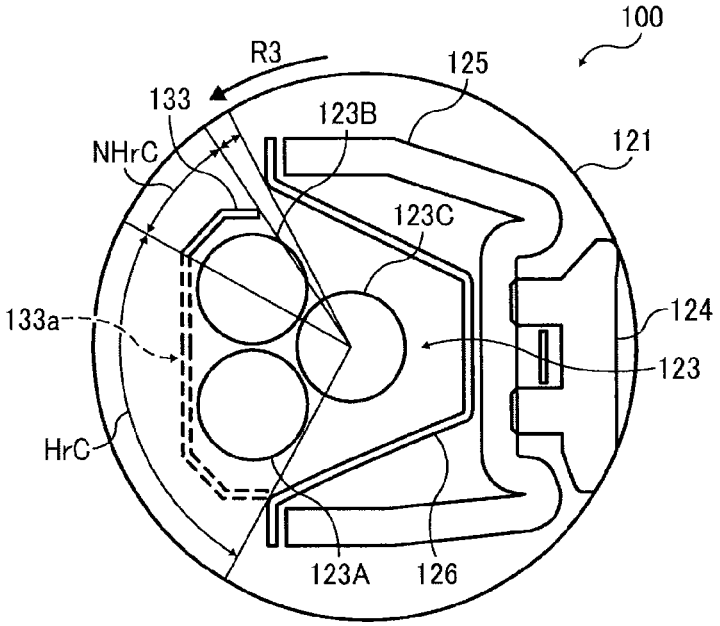
FIG. 6B is a partial vertical sectional view of the fixing device shown in FIG. 2 taken on the line A-A of FIG. 3A illustrating another heated region of the fixing belt heated by another one of the halogen heaters shown in FIG. 5.

With reference to FIGS. 6A and 6B, a description is provided of a heated region of the fixing belt 121 heated by light radiated from the halogen heaters 123B and 123C.

FIG. 6A is a partial vertical sectional view of the fixing device 100 taken on the line A-A of FIG. 3A illustrating the heated region of the fixing belt 121 heated by light radiated from the halogen heater 123B. FIG. 6B is a partial vertical sectional view of the fixing device 100 taken on the line A-A of FIG. 3A illustrating the heated region of the fixing belt 121 heated by light radiated from the halogen heater 123C. The line A-A of FIG. 3A is in the lateral end P2*e* of the passage region P2 of the fixing belt 121 shown in FIG. 5 where the non-passage region NP1 of the fixing belt 121 where the double letter size recording medium DLT does not pass overlaps the passage region P2 of the fixing belt 121 where the A3 size recording medium A3T passes in the axial direction of the fixing belt 121.

As shown in FIG. 6A, a heated region HrB of the fixing belt 121 in the rotation direction R3 of the fixing belt 121 is disposed opposite the halogen heater 123B through the notch 133*a* of the shield 133. Hence, the heated region HrB of the fixing belt 121 is heated by light radiated from the halogen heater 123B and irradiated thereto through the notch 133*a* of the shield 133. Conversely, a non-heated region NHrB of the fixing belt 121 in the rotation direction R3 of the fixing belt 121 is disposed opposite the halogen heater 123B via the shield 133. Hence, the non-heated region NHrB of the fixing belt 121 is shielded from light radiated from the halogen heater 123B by the shield 133 and therefore is not heated by the halogen heater 123B. Accordingly, at the lateral end P2*e* of the passage region P2 of the fixing belt 121 where the A3 size recording medium A3T passes which overlaps the non-passage region NP1 of the fixing belt 121 where the double letter size recording medium DLT does not pass in the axial direction of the fixing belt 121, the shield 133 shields the fixing belt 121 from light radiated from the halogen heater 123B at a predetermined rate. Consequently, the shield 133, compared to a configuration without the shield 133, reduces overheating of the non-passage region NP1 of the fixing belt 121 where the double letter size recording medium DLT does not pass during printing on the double letter size recording medium DLT.

As shown in FIG. 6B, a non-heated region NHrC of the fixing belt 121 in the rotation direction R3 thereof is disposed opposite the halogen heater 123C via the shield 133. Hence, the non-heated region NHrC of the fixing belt 121 is shielded from light radiated from the halogen heater 123C by the shield 133 and therefore is not heated by the halogen heater 123C. Conversely, a heated region HrC of the fixing belt 121 in the rotation direction R3 thereof is disposed opposite the halogen heater 123C through the notch 133*a* of the shield 133. Hence, the heated region HrC of the fixing belt 121 is heated by light radiated from the halogen heater 123C and irradiated thereto through the notch 133*a* of the shield 133. Accordingly, as shown in FIG. 5, the lateral end P2*e* of the passage region P2 of the fixing belt 121 where the A3 size recording medium A3T passes is heated by light radiated from the halogen heater 123C and irradiated thereto through the notch 133*a* of the shield 133. The shield 133, compared to a configuration without the notch 133*a*, allows the halogen heater 123C to heat the lateral end P2*e* of the passage region P2 of the fixing belt 121 where the A3 size recording medium A3T passes with an increased area, thus minimizing fixing failure that may arise due to a decreased temperature lower than the predetermined fixing temperature at the lateral end P2*e* of the passage region P2 of the fixing belt 121 during printing on the A3 size recording medium A3T.

With the configuration described above, the fixing device 100 reduces overheating of the non-passage region NP1 of the fixing belt 121 where the double letter size recording medium DLT does not pass and the non-passage region NP2 of the fixing belt 121 where the A3 size recording medium A3T does not pass. Simultaneously, the fixing device 100 minimizes fixing failure that may arise due to decreased temperature at the lateral end P2*e* of the passage region P2 of the fixing belt 121 where the A3 size recording medium A3T passes, which is disposed at both lateral ends of the fixing belt 121 in the axial direction thereof.

With reference to FIGS. 1, 2, 5, 6A, and 6B, a description is provided of advantages of the fixing device 100 and the image forming apparatus 1000 incorporating the fixing device 100 according to the exemplary embodiments described above.

As shown in FIGS. 2 and 5, the fixing device 100 includes the fixing belt 121 serving as a hollow, endless rotary body; the pressing roller 122 serving as a pressing body that contacts the outer circumferential surface of the fixing belt 121; the nip formation assembly 124 disposed opposite the inner circumferential surface of the fixing belt 121 and pressing against the pressing roller 122 via the fixing belt 121 to form the fixing nip N between the fixing belt 121 and the pressing roller 122; and the halogen heater set 123 serving as a heater set disposed opposite the inner circumferential surface of the fixing belt 121 and irradiating the fixing belt 121 with light, that is, radiation heat. The fixing device 100 allows recording media P of at least two sizes to pass between the fixing roller 121 and the pressing roller 122, that is, a first size recording medium (e.g., a double letter size recording medium DLT in portrait orientation) and a second size recording medium (e.g., an A3 size recording medium A3T in portrait orientation) greater that the first size recording medium in width in the axial direction of the fixing belt 121. The halogen heater set 123 includes a plurality of heaters disposed opposite different regions on the fixing belt 121 in the axial direction thereof, respectively. The plurality of heaters includes at least the halogen heater 123B serving as a first heater disposed opposite each lateral end P1*e* of the passage region P1, that is, a first passage region, of the fixing belt 121 in the axial direction thereof where the first size recording medium passes and the halogen heater 123C serving as a second heater disposed opposite each lateral end P1*e* of the passage region P1 and each lateral end P2*e* of the passage region P2, that is, a second passage region, of the fixing belt 121 in the axial direction thereof where the second size recording medium passes. The fixing device 100 further includes the shield 133 interposed between the fixing belt 121 and the halogen heaters 123B and 123C to shield the fixing belt 121 from heat radiated from the halogen heaters 123B and 123C. The shield 133 includes the notch 133*a* disposed opposite each lateral end P2*e* of the passage region P2 of the fixing belt 121 which overlaps the non-passage region NP1 of the fixing belt 121 in the axial direction thereof where the first size recording medium does not pass.

Accordingly, the shield 133 reduces overheating of the non-passage region NP1 of the fixing belt 121 where the first size recording medium does not pass and the non-passage region NP2 of the fixing belt 121 where the second size recording medium does not pass. Simultaneously, the shield 133 prevents temperature decrease in the lateral end P2*e* of the passage region P2 of the fixing belt 121 where the second size recording medium passes, thus minimizing fixing failure that may arise due to the decreased temperature of the fixing belt 121.

As shown in FIG. 6A, the halogen heater 123C is disposed downstream from the halogen heater 123B in the rotation direction R3 of the fixing belt 121.

As shown in FIG. 5, the shield 133 further includes a body 133*d* and an upstream arm 133*b* projecting from the body 133*d* toward a center of the fixing belt 121 in the axial direction thereof and disposed upstream from the notch 133*a* in the rotation direction R3 of the fixing belt 121. The notch 133*a* is formed into a rectangle extending in the axial direction of the fixing belt 121 by eliminating a downstream portion of the shield 133 in the rotation direction R3 of the fixing belt 121 such that the rectangular notch 133*a* extends in the axial direction of the fixing belt 121 along the adjacent upstream arm 133*b*. Accordingly, the notch 133*a* allows heat radiated from the halogen heater 123C to be conducted to the lateral end P2*e* of the passage region P2 of the fixing belt 121 where the second size recording medium passes without being blocked by the shield 133, thus facilitating efficient heating of the fixing belt 121 by the halogen heater 123C.

As shown in FIG. 3B, the fixing device 100 further includes the belt holder 140 disposed opposite the inner circumferential surface of the fixing belt 121 at each lateral end of the fixing belt 121 in the axial direction thereof and serving as a guide that guides the fixing belt 121 rotating in a predetermined rotation locus. The shield 133 is interposed between the belt holder 140 and the halogen heaters 123B and 123C to shield the belt holder 140 from heat radiated from the halogen heaters 123B and 123C. Accordingly, the shield 133 minimizes thermal wear of the belt holder 140.

As shown in FIG. 3A, the fixing device 100 further includes the stay 125 contacting the shield 133 and serving as a dissipator that dissipates heat conducted from the shield 133. Accordingly, the stay 125 prevents overheating of the shield 133, minimizing thermal wear of the shield 133.

As shown in FIG. 3A, the opposed face 133*c* of the shield 133 disposed opposite the halogen heaters 123B and 123C has an overall reflectance not greater than about 80 percent.

Accordingly, the shield 133 minimizes thermal wear of the components surrounding the shield 133 due to temperature increase.

The shield 133 has resistance against temperatures up to about 400 degrees centigrade. Accordingly, the shield 133 minimizes thermal wear of itself due to temperature increase.

As shown in FIG. 5, the fixing device 100 further includes the halogen heater 123A serving as a third heater disposed opposite and heating the center passage region P3 of the fixing belt 121 in the axial direction thereof where a third size recording medium (e.g., the letter size recording medium in portrait orientation) passes. As shown in FIG. 2, the three axes 123Ax, 123Bx, and 123Cx of the three halogen heaters 123A, 123B, and 123C constitute the three vertices of the triangle Ta in cross-section. The halogen heater 123C is interposed between the nip formation assembly 124 and the halogen heaters 123A and 123B in the diametrical direction of the fixing belt 121. Accordingly, before a recording medium of frequently used size, that is, the first size recording medium or the third size recording medium, is conveyed through the fixing nip N, the halogen heaters 123A and 123B disposed opposite the passage regions P3 and P1 of the fixing belt 121 where the third and first size recording media pass, respectively, and situated closer to the inner circumferential surface of the fixing belt 121 than the halogen heater 123C heat the fixing belt 121 efficiently.

As shown in FIG. 1, the image forming apparatus 1000 includes an image carrier (e.g., the photoconductive drums 20Y, 20C, 20M, and 20K); an electrostatic latent image formation device (e.g, the optical writer 8) that forms an electrostatic latent image on the image carrier; a development device (e.g., the development devices 40Y, 40C, 40M, and 40K) that visualizes the electrostatic latent image into a toner image with toner; a transfer device (e.g., the transfer device 71) that transfers the toner image formed on the image carrier onto a recording medium; and the fixing device described above (e.g., the fixing device 100) that fixes the toner image on the recording medium. Accordingly, the fixing device 100 incorporated in the image forming apparatus 1000, with the above-described configuration of the shield 133, reduces overheating of the fixing belt 121 in the non-passage region NP1 of the fixing belt 121 where the first size recording medium does not pass and the non-passage region NP2 of the fixing belt 121 where the second size recording medium does not pass. Simultaneously, the fixing device 100, with the above-described configuration of the notch 133*a* of the shield 133, minimizes fixing failure that may arise due to decreased temperature at the lateral end P2*e* of the passage region P2 of the fixing belt 121 where the second size recording medium passes.

The present invention is not limited to the details of the exemplary embodiments described above, and various modifications and improvements are possible. For example, as shown in FIG. 1, the image forming apparatus 1000 incorporating the fixing device 100 is a color laser printer. Alternatively, the image forming apparatus 1000 may be a monochrome printer, a copier, a facsimile machine, a multifunction printer (MFP) having at least one of copying, printing, facsimile, and scanning functions, or the like.

As shown in FIGS. 5 and 6B, the shield 133 shields the non-passage region NP2 of the fixing belt 121 where the second size recording medium does not pass from heat radiated from the halogen heater 123C. Similarly, the shield 133, with the upstream arm 133*b*, shields the non-passage region NP1 of the fixing belt 121 where the first size recording medium does not pass while the shield 133, with the notch 133*a*, allows heat radiated from the halogen heater 123C to be conducted to the lateral end P2*e* of the passage region P2 of the fixing belt 121 where the second size recording medium passes without being blocked by the shield 133. Accordingly, compared to a configuration without the shield 133, the fixing device 100 reduces overheating of the non-passage region NP2 of the fixing belt 121 where the second size recording medium does not pass that may be caused by heat from the halogen heater 123C. Similarly, the fixing device 100 reduces overheating of the non-passage region NP1 of the fixing belt 121 where the first size recording medium does not pass that may be caused by heat from the halogen heater 123B.

For example, the notch 133*a* of the shield 133 disposed opposite the lateral end P2*e* of the passage region P2 of the fixing belt 121 where the second size recording medium passes, which overlaps the non-passage region NP1 of the fixing belt 121 where the first size recording medium does not pass in the axial direction thereof, allows heat from the halogen heaters 123B and 123C to reach the fixing belt 121. Accordingly, as shown in FIG. 6B, the lateral end P2*e* of the passage region P2 of the fixing belt 121 where the second size recording medium passes is heated by heat radiated from the halogen heater 123C and irradiating thereto through the notch 133*a*. Consequently, the shield 133, compared to a configuration without the notch 133*a*, allows the halogen heater 123C to heat the lateral end P2*e* of the passage region P2 of the fixing belt 121 where the second size recording medium passes with an increased area, thus minimizing fixing failure that may arise due to a decreased temperature lower than the predetermined fixing temperature at each lateral end P2*e* of the passage region P2 during printing on the second size recording medium.

According to the exemplary embodiments described above, the shield 133 having the notch 133*a* is employed in the fixing device 100 incorporating the plurality of halogen heaters 123A, 123B, and 123C. Alternatively, the shield 133 may be employed in a fixing device 100S incorporating a single halogen heater 123H as shown in FIG. 7.

Figure 7:
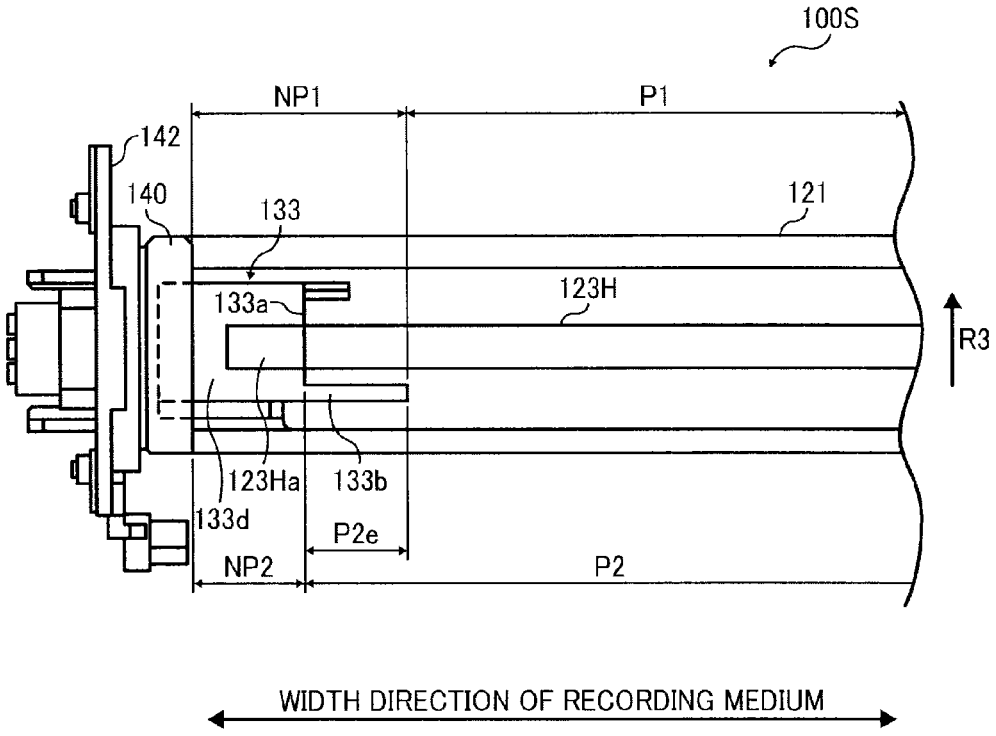
FIG. 7 is a partial plan view of a fixing device according to a second exemplary embodiment of the present invention.

With reference to FIG. 7, a description is provided of a configuration of the fixing device 100S incorporating the single halogen heater 123H and the shield 133.

FIG. 7 is a partial plan view of the fixing device 100S according to a second exemplary embodiment illustrating one lateral end of the fixing belt 121 in the axial direction thereof. As shown in FIG. 7, the fixing device 100S includes the halogen heater 123H instead of the halogen heaters 123A, 123B, and 123C depicted in FIG. 5. The halogen heater 123H extends throughout substantially the entire width of the fixing belt 121 in the axial direction thereof, thus heating both the double letter size recording medium DLT and the A3 size recording medium A3T. For example, the halogen heater 123H is disposed opposite the non-passage region NP1 of the fixing belt 121 where the double letter size recording medium DLT in portrait orientation does not pass. Accordingly, after the plurality of double letter size recording media DLT passes over the fixing belt 121 continuously while the halogen heater 123H is turned on, the non-passage region NP1 of the fixing belt 121 may overheat because the plurality of double letter size recording media DLT does not pass over the non-passage region NP1 of the fixing belt 121 and therefore does not draw heat therefrom. To address this problem, the shield 133 shields a part of the non-passage region NP1 of the fixing belt 121 from light radiated from the halogen heater 123H, thus decreasing an amount of light radiated from the halogen heater 123H that reaches the non-passage region NP1 of the fixing belt 121.

Similarly, an outboard lateral end 123Ha of the halogen heater 123H in the axial direction of the fixing belt 121 is disposed opposite the non-passage region NP2 of the fixing belt 121 where the A3 size recording medium A3T in portrait orientation does not pass. Accordingly, after the plurality of A3 size recording media A3T passes over the fixing belt 121 continuously while the halogen heater 123H is turned on, the non-passage region NP2 of the fixing belt 121 may overheat because the plurality of A3 size recording media A3T does not pass over the non-passage region NP2 of the fixing belt 121 and therefore does not draw heat therefrom. To address this problem, the shield 133 shields the non-passage region NP2 of the fixing belt 121 from light radiated from the halogen heater 123H, thus decreasing an amount of light radiated from the halogen heater 123H that reaches the non-passage region NP2 of the fixing belt 121.

Hence, the shield 133 shields the non-passage regions NP1 and NP2 of the fixing belt 121 from light radiated from the halogen heater 123H, minimizing overheating of the non-passage regions NP1 and NP2 of the fixing belt 121 after the plurality of double letter size recording media DLT and the plurality of A3 size recording media A3T continuously pass over the fixing belt 121, respectively, and thereby preventing wear and damage of the fixing belt 121 caused by heat from the halogen heater 123H.

However, if the shield 133 is configured to shield the entire non-passage region NP1 of the fixing belt 121 where the double letter size recording medium DLT does not pass, during passage of the double letter size recording medium DLT, the shield 133 may also prevent light radiated from the halogen heater 123H from reaching the fixing belt 121 unnecessarily. Accordingly, such shield 133 may unnecessarily restrict heating of an area on the fixing belt 121 that need to be heated by the halogen heater 123H. For example, the lateral end P2*e* of the passage region P2 of the fixing belt 121 in the axial direction thereof where the A3 size recording medium A3T passes may not be heated by the halogen heater 123H to the predetermined fixing temperature, resulting in fixing failure.

To address this problem, the shield 133 has the shape that reduces overheating of the non-passage region NP1 of the double letter size recording medium DLT and the non-passage region NP2 of the A3 size recording medium A3T and at the same time minimizes fixing failure at the lateral end P2*e* of the passage region P2 of the A3 size recording medium A3T that may arise due to insufficient heating. For example, as shown in FIG. 7, the shield 133 is produced with the rectangular notch 133*a* disposed opposite the lateral end P2*e* of the passage region P2 of the fixing belt 121 where the A3 size recording medium A3T passes. Specifically, at the lateral end P2*e* of the passage region P2 of the fixing belt 121, the non-passage region NP1 of the fixing belt 121 where the double letter size recording medium DLT does not pass overlaps the passage region P2 of the fixing belt 121 where the A3 size recording medium A3T passes in the axial direction of the fixing belt 121.

According to the exemplary embodiments described above, the heaters (e.g., the halogen heaters 123A, 123B, and 123C depicted in FIG. 5 and the halogen heater 123H depicted in FIG. 7) are situated symmetrically via a center of the fixing belt 121 in the axial direction thereof. Alternatively, the heaters may be aligned along one lateral edge of the fixing belt 121 in the axial direction thereof such that the non-passage regions NP1 and NP2 are produced only at one lateral end of the fixing belt 121 in the axial direction thereof. In this case, the single shield 133 may be disposed opposite the non-passage regions NP1 and NP2 situated only at one lateral end of the fixing belt 121 in the axial direction thereof.

Figure 8:
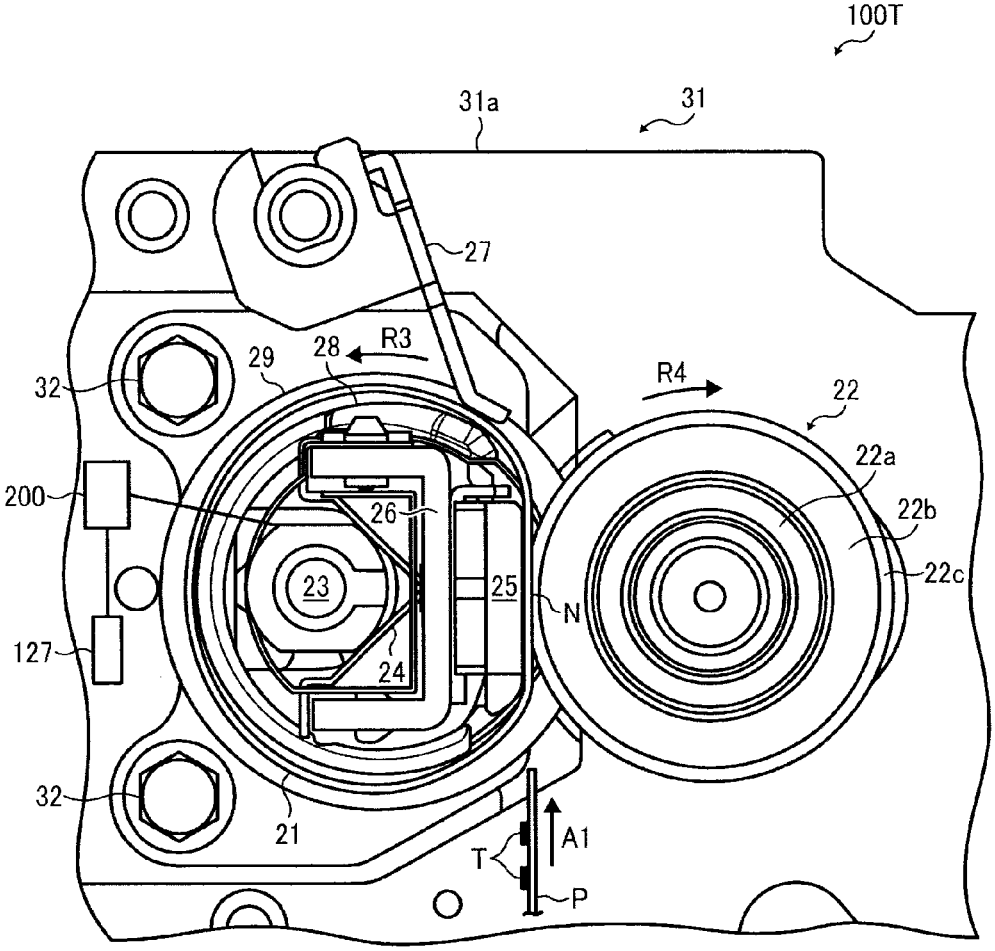
FIG. 8 is a vertical sectional view of a fixing device according to a third exemplary embodiment of the present invention.

With reference to FIG. 8, a description is provided of a configuration of a fixing device 100T according to a third exemplary embodiment.

FIG. 8 is a vertical sectional view of the fixing device 100T. As shown in FIG. 8, the fixing device 100T includes a fixing belt 21 formed into a loop; a pressing roller 22 disposed opposite an outer circumferential surface of the fixing belt 21; a heater 23 disposed inside the loop formed by the fixing belt 21; a reflector 24 disposed opposite the heater 23; a nip formation assembly 25 pressing against the pressing roller 22 via the fixing belt 21 to form a fixing nip N between the fixing belt 21 and the pressing roller 22; a support 26 contacting and supporting the nip formation assembly 25; a separator 27 disposed opposite the outer circumferential surface of the fixing belt 21; a pair of belt holders 28 contacting and supporting the fixing belt 21 at both lateral ends in an axial direction thereof; and a pair of protectors 29 contactably disposed opposite the fixing belt 21 at both lateral ends in the axial direction thereof.

The fixing device 100T further includes a cabinet 31 housing the components of the fixing device 100T described above; a plurality of bolts 32 that bolts the belt holder 28 to the cabinet 31; the temperature sensor 127; and the controller 200 operatively connected to the temperature sensor 127 and the heater 23 to control the heater 23 based on the temperature of the fixing belt 21 detected by the temperature sensor 127. The fixing device 100T is detachably installed inside the body 2 of the image forming apparatus 1000 depicted in FIG. 1.

As a recording medium P bearing a toner image T is conveyed through the fixing nip N formed between the fixing belt 21 and the pressing roller 22, the fixing belt 21 heated by the heater 23 and the pressing roller 22 apply heat and pressure to the recording medium P, thus fixing the toner image T on the recording medium P. As the recording medium P bearing the fixed toner image T is discharged from the fixing nip N, the separator 27 separates the recording medium P from the fixing belt 21. Thereafter, the recording medium P is conveyed through the conveyance path R to the output roller pair 7 depicted in FIG. 1.

Figure 9:
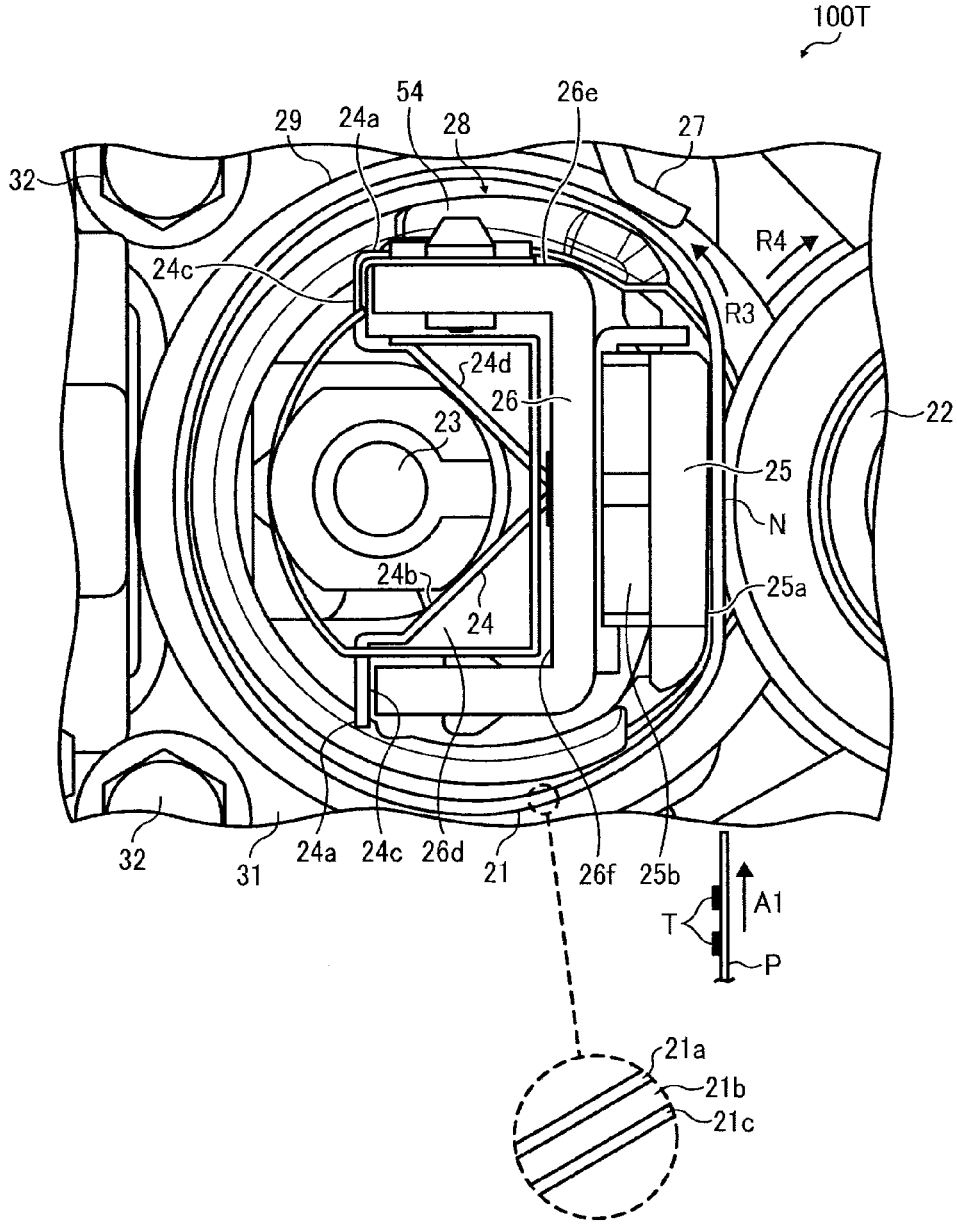
FIG. 9 is an enlarged vertical sectional view of the fixing device shown in FIG. 8 illustrating a fixing belt incorporated therein.

With reference to FIG. 9, a detailed description is now given of a construction of the fixing belt 21.

FIG. 9 is an enlarged vertical sectional view of the fixing device 100T illustrating the fixing belt 21 and the components situated inside the loop formed by the fixing belt 21. As shown in FIG. 9, the fixing belt 21 is constructed of a base layer 21*a*; an elastic layer 21*b* coating the base layer 21*a*; and a release layer 21*c* coating the elastic layer 21*b*. The flexible fixing belt 21 has a thickness of about 1 mm. The fixing belt 21 has a long width corresponding to a width of the recording medium P in the axial direction of the fixing belt 21. The fixing belt 21 has a loop diameter of about 25 mm in cross-section orthogonal to the axial direction of the fixing belt 21.

Alternatively, the fixing belt 21 may not incorporate the elastic layer 21*b*. In this case, the fixing belt 21 has a reduced thermal capacity that facilitates heating of the fixing belt 21 by the heater 23 and thereby saving energy. Further, the loop diameter of the fixing belt 21 may be in a range of from about 15 mm to about 120 mm according to settings of the fixing device 100T. As shown in FIG. 8, as the pressing roller 22 rotates in the rotation direction R4, the fixing belt 21 rotates in the rotation direction R3 in accordance with rotation of the pressing roller 22. That is, the fixing belt 21 is driven and rotated by the pressing roller 22. As the fixing belt 21 and the pressing roller 22 rotate in the rotation directions R3 and R4, respectively, the recording medium P is conveyed through the fixing nip N in the recording medium conveyance direction A1 and discharged from the fixing nip N.

As shown in FIG. 9, the base layer 21*a* of the fixing belt 21 is made of a material having a desired mechanical strength, for example, metal such as nickel (Ni) and SUS stainless steel or resin such as polyimide and has a thickness in a range of from about 20 micrometers to about 100 micrometers. For example, the base layer 21*a* may be thin, metal or resin film.

The elastic layer 21*b* of the fixing belt 21 is made of rubber such as silicone rubber (Q) and fluoro rubber (FKM) and has a thickness in a range of from about 20 micrometers to about 900 micrometers. The elastic layer 21*b* absorbs surface asperities of the fixing belt 21 and the recording medium P. Accordingly, as the fixing belt 21 and the pressing roller 22 apply heat and pressure to the recording medium P conveyed through the fixing nip N, the elastic layer 21*b*, by absorbing surface asperities of the fixing belt 21 and the recording medium P, facilitates uniform application of heat and pressure to the recording medium P. As the fixing belt 21 and the pressing roller 22 exert pressure to the toner image T on the recording medium P to fix the toner image T on the recording medium P, slight surface asperities of the fixing belt 21 may be transferred onto the toner image T on the recording medium P, producing variation in gloss on the solid toner image T that results in formation of an orange peel image. To address this problem, the elastic layer 21*b* of the fixing belt 21 having a thickness not smaller than about 100 micrometers deforms and absorbs slight surface asperities of the fixing belt 21, thus minimizing variation in gloss of the solid toner image T, that is, minimizing formation of an orange peel image.

The release layer 21*c* of the fixing belt 21 is made of a material that facilitates separation of the recording medium P and the toner image T formed thereon from the fixing belt 21, that is, a material that prevents adhesion and sticking of toner of the toner image T to the fixing belt 21 and is used on a surface of a die, for example. For example, the release layer 21*c* is made of resin such as PFA, PTFE, polyether imide (PEI), and PES and has a thickness in a range of from about 1 micrometer to about 200 micrometers.

With reference to FIG. 8, a detailed description is now given of a construction of the pressing roller 22.

As shown in FIG. 8, the pressing roller 22 is constructed of a roller-shaped metal core 22*a*, an elastic layer 22*b* coating the metal core 22*a*, and a release layer 22*c* coating the elastic layer 22*b*. A driving mechanism disposed inside the image forming apparatus 1000 depicted in FIG. 1 generates a driving force that drives and rotates the pressing roller 22. For example, the driving mechanism is constructed of a driver (e.g., a motor) and a reduction gearing (e.g., reduction gears). As a pressurization assembly presses the pressing roller 22 against the nip formation assembly 25 via the fixing belt 21, the elastic layer 22*b* of the pressing roller 22 is elastically deformed by pressure from the pressurization assembly, thus forming the fixing nip N.

The metal core 22*a*, that is, a solid tube having a desired mechanical strength, is made of thermally conductive metal such as carbon steel (e.g., SC and STKM) and aluminum (Al). Alternatively, the metal core 22*a* may be a hollow tube accommodating a heater such as a halogen heater that heats the recording medium P conveyed through the fixing nip N via the metal core 22*a*, the elastic layer 22*b*, and the release layer 22*c*.

Similar to the elastic layer 21*b* of the fixing belt 21 described above, the elastic layer 22*b* of the pressing roller 22 is made of synthetic rubber such as silicone rubber (Q) and fluoro rubber (FKM). The synthetic rubber is relatively rigid, non-foaming solid rubber. If no heater is situated inside the metal core 22*a*, the elastic layer 22*b* may be made of foaming synthetic rubber such as sponge rubber. The sponge rubber, as it contains foam, provides an increased insulation that insulates the pressing roller 22 from the fixing belt 21 heated by the heater 23. Hence, heat is not drawn from the fixing belt 21 to the pressing roller 22, saving energy.

Like the release layer 21*c* of the fixing belt 21, the release layer 22*c* of the pressing roller 22 is made of a thermally conductive, durable material that facilitates separation of the recording medium P from the pressing roller 22 and enhances durability of the elastic layer 22*b*. For example, the release layer 22*c* is produced by coating of the elastic layer 22*b* with PFA or fluoroplastic coating made of PFA or PTFE. Alternatively, the release layer 22*c* may be a silicone rubber layer or a fluoro rubber layer.

With reference to FIG. 8, a detailed description is now given of a construction of the heater 23.

The heater 23 mounted on the cabinet 31 is situated inside the loop formed by the fixing belt 21 and spaced apart from an inner circumferential surface of the fixing belt 21. The heater 23 has a single light emission region that generates radiation heat to heat the fixing belt 21 directly. The heater 23 is a radiant heater such as a halogen heater incorporating a halogen lamp that generates radiation heat, a carbon heater incorporating a quartz tube filled with carbon fiber in inert gas, and a ceramic heater including resistance wiring embedded inside ceramic. The controller 200 controls powering on and off of the heater 23.

With reference to FIG. 9, a detailed description is now given of a construction of the reflector 24.

As shown in FIG. 9, the reflector 24 is constructed of a mount 24*a* mounted on the cabinet 31; a reflection face 24*b* that reflects light emitted from the heater 23 toward the inner circumferential surface of the fixing belt 21; and a cover 24*c* that covers the support 26. The mount 24*a* is situated at each lateral end of the reflector 24 in the axial direction of the fixing belt 21 and mounted on the cabinet 31 through the belt holder 28. The reflection face 24*b* is interposed between the support 26 and the heater 23 in a diametrical direction of the fixing belt 21. The reflection face 24*b*, disposed opposite the heater 23, is bent at a center thereof in the recording medium conveyance direction A1 to house the heater 23.

With reference to FIG. 9, a detailed description is now given of a construction of the nip formation assembly 25.

As shown in FIG. 9, the nip formation assembly 25 has a long width in a width direction of the recording medium P parallel to the axial direction of the fixing belt 21. A cross-section of the nip formation assembly 25 perpendicular to the width direction of the recording medium P is substantially rectangular. As the fixing belt 21 rotates in the rotation direction R3, it slides over the nip formation assembly 25. For example, the nip formation assembly 25 is constructed of a contact face portion 25*a* over which the fixing belt 21 slides and a coupling portion 25*b* coupled with the support 26. The nip formation assembly 25 is disposed opposite the inner circumferential surface of the fixing belt 21 and is mounted on the cabinet 31.

The contact face portion 25*a* has a plane disposed opposite the pressing roller 22 via the fixing belt 21. As the pressing roller 22 presses the fixing belt 21 against the nip formation assembly 25, the fixing belt 21 comes into contact with the plane of the contact face portion 25*a* of the nip formation assembly 25. Simultaneously, as the pressing roller 22 presses the fixing belt 21 against the nip formation assembly 25, the elastic layer 22*b* depicted in FIG. 8 of the pressing roller 22 is pressed and deformed into a plane corresponding to the plane of the contact face portion 25*a* of the nip formation assembly 25. The elastic layer 22*b* deformed into the plane produces the fixing nip N having a predetermined length in the recording medium conveyance direction A1.

According to this exemplary embodiment, the contact face portion 25*a* of the nip formation assembly 25 has the plane as described above. Alternatively, the contact face portion 25*a* may have other shapes. For example, the contact face portion 25*a* may have a concave curve with respect to the fixing belt 21 that corresponds to a circumference of the pressing roller 22. The concave curve of the contact face portion 25*a* directs a leading edge of the recording medium P discharged from the fixing nip N toward the pressing roller 22, thus facilitating separation of the recording medium P from the fixing belt 21 and thereby preventing jamming of the recording medium P conveyed through the fixing device 100T.

Figure 10:
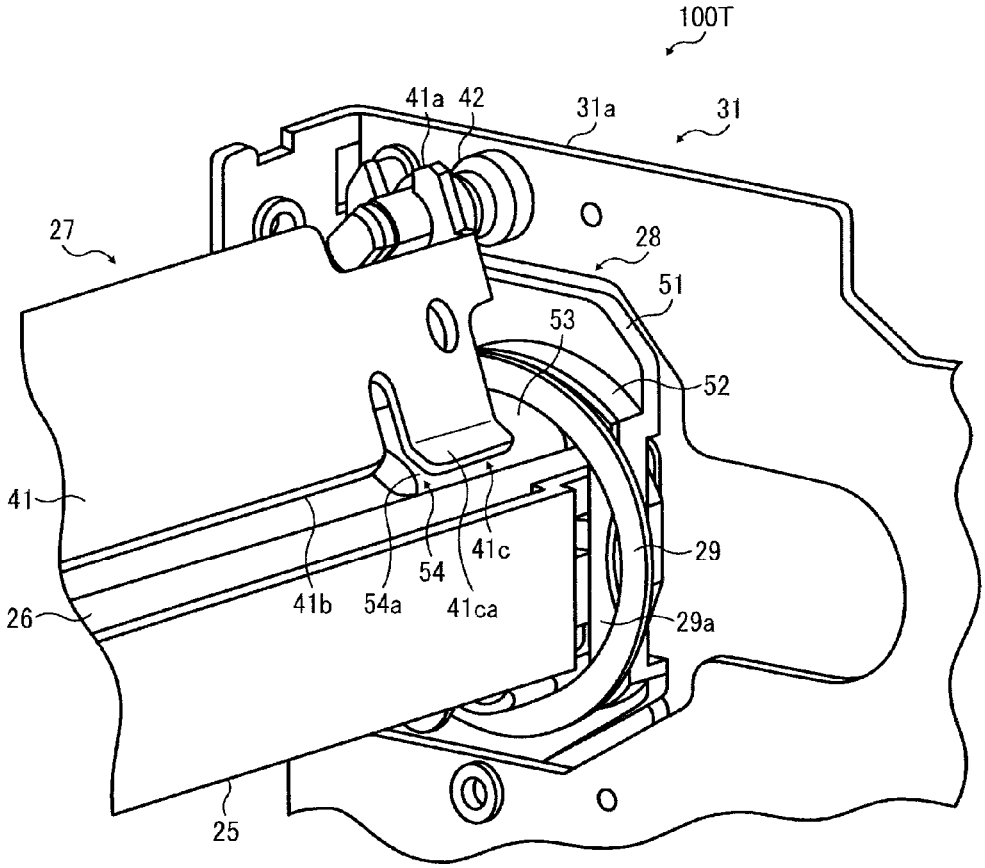
FIG. 10 is a partial perspective view of the fixing device shown in FIG. 9 illustrating one lateral end thereof in an axial direction of the fixing belt.
Figure 11A:
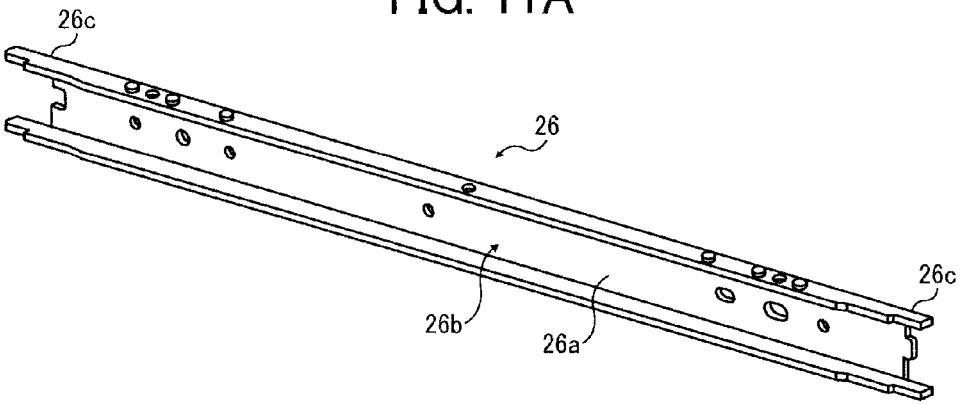
FIG. 11A is a perspective view of a support incorporated in the fixing device shown in FIG. 9 seen from a heater adjacent thereto.
Figure 11B:
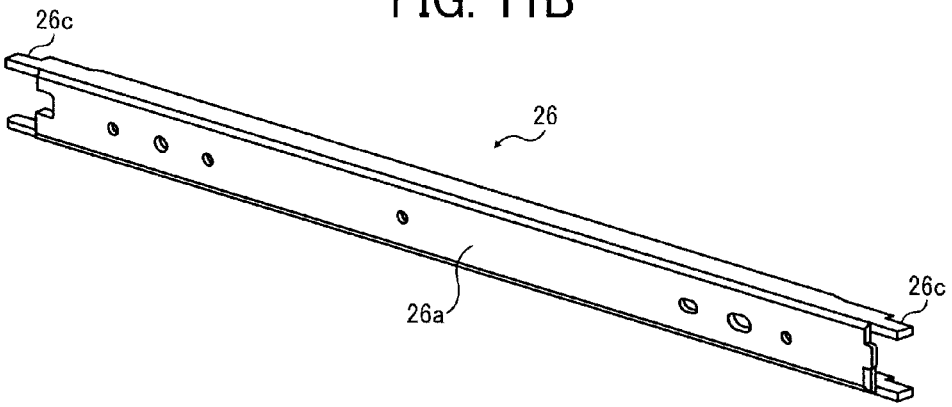
FIG. 11B is a perspective view of the support shown in FIG. 11A seen from a nip formation assembly adjacent thereto.

With reference to FIGS. 10, 11A, and 11B, a detailed description is now given of a construction of the support 26.

FIG. 10 is a partial perspective view of the fixing device 100T illustrating one lateral end thereof in the axial direction of the fixing belt 21. FIG. 11A is a perspective view of the support 26 seen from the heater 23 depicted in FIG. 9. FIG. 11B is a perspective view of the support 26 seen from the nip formation assembly 25 depicted in FIG. 9. As shown in FIGS. 10 and 11A, like the nip formation assembly 25 depicted in FIG. 10, the support 26 has a long width in the width direction of the recording medium P parallel to the axial direction of the fixing belt 21. As shown in FIG. 9, a cross-section of the support 26 perpendicular to the width direction of the recording medium P is formed into a square bracket producing an opening 26*d* that houses the heater 23.

As shown in FIGS. 9 and 11A, the support 26 is constructed of a support portion 26*a* that contacts and supports the nip formation assembly 25; a housing portion 26*b* producing the opening 26*d* that houses the heater 23 and the reflector 24; and an engagement portion 26*c* disposed at each lateral end of the support 26 in a longitudinal direction thereof parallel to the axial direction of the fixing belt 21 and engaged with the cabinet 31. The support portion 26*a* of the support 26 is coupled with the coupling portion 25*b* of the nip formation assembly 25 to support the nip formation assembly 25 against pressure from the pressing roller 22, thus preventing bending of the nip formation assembly 25 in the axial direction of the fixing belt 21. Accordingly, the support 26 helps the nip formation assembly 25 produce the fixing nip N evenly throughout the entire width of the recording medium P in the axial direction of the fixing belt 21. Like the nip formation assembly 25, the support 26, disposed opposite the inner circumferential surface of the fixing belt 21, is mounted on the cabinet 31 with the engagement portions 26*c* that are fastened to the cabinet 31 with a fastener.

As shown in FIG. 9, the cover 24*c* of the reflector 24 covers substantially the entire opening 26*d* of the support 26 in the axial direction of the fixing belt 21. Thus, the reflector 24 protects the support 26 against heat radiated from the heater 23, minimizing waste of energy. Alternatively, instead of mounting the reflector 24, an inner circumferential surface of the housing portion 26*b* depicted in FIG. 11A of the support 26 may be mirror finished to attain the advantages described above. Further, the inner circumferential surface of the housing portion 26*b* of the support 26 may be formed of an insulator that insulates the support 26 from heat conducted from the heater 23.

With reference to FIGS. 8 and 10, a detailed description is now given of a construction of the separator 27.

It is to be noted that the fixing belt 21 is not illustrated in FIG. 10. As shown in FIG. 10, the separator 27 is constructed of a separation plate 41 disposed opposite the outer circumferential surface of the fixing belt 21; a pair of support shafts 42 in contact with both lateral ends of the separation plate 41 in the axial direction of the fixing belt 21, respectively, to rotatably support the separation plate 41; and a spring that biases the separation plate 41 against the fixing belt 21. The separation plate 41 is constructed of a pair of supported portions 41*a*, a separation portion 41*b*, and a pair of positioning portions 41*c*. The pair of supported portions 41*a* is disposed at both lateral ends of the separator 27, respectively, in the axial direction of the fixing belt 21. The supported portion 41*a* is contacted and supported by the support shaft 42. The planar separation portion 41*b* contacts the leading edge of the recording medium P discharged from the fixing nip N, thus separating the recording medium P from the fixing belt 21. The positioning portion 41*c* is contiguous to the separation portion 41*b* at each lateral end of the separation portion 41*b* in the axial direction of the fixing belt 21 and includes a bent front 41*ca* that contacts the outer circumferential surface of the fixing belt 21. As the bent front 41*ca* of the positioning portion 41*c* of the separation plate 41 comes into contact with the fixing belt 21, the separation plate 41 is positioned with respect to the fixing belt 21.

Figure 12:
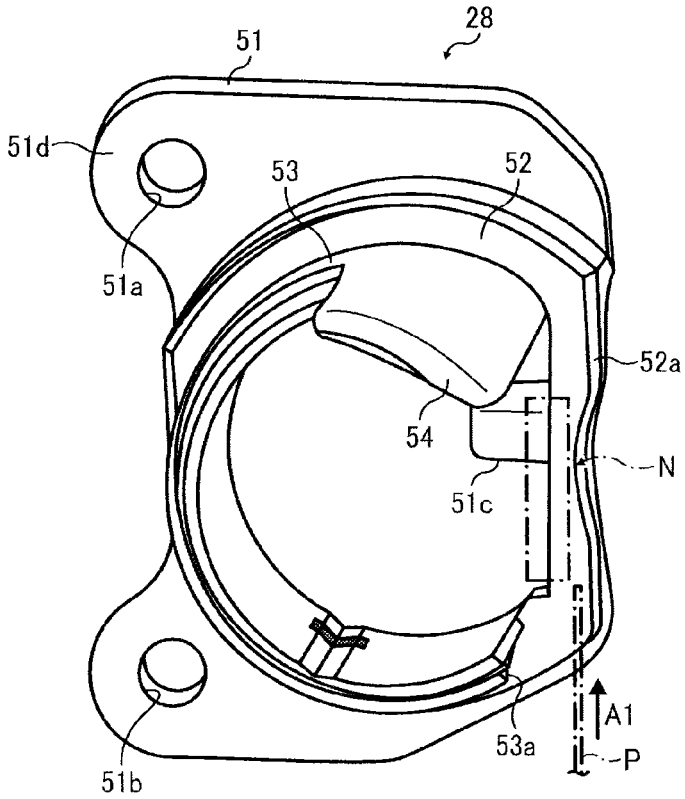
FIG. 12 is a perspective view of a belt holder incorporated in the fixing device shown in FIG. 9.
Figure 13:
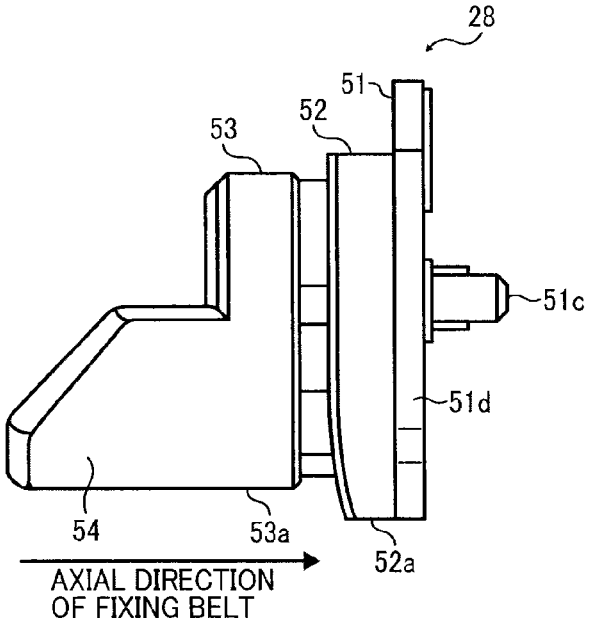
FIG. 13 is a plan view of the belt holder shown in FIG. 12.

With reference to FIGS. 12 and 13, a detailed description is now given of a construction of the belt holder 28.

FIG. 12 is a perspective view of the belt holder 28. FIG. 13 is a plan view of the belt holder 28. As shown in FIGS. 12 and 13, the belt holder 28 is constructed of a flange 51, a base 52, a primary projection 53, and a secondary projection 54, which are integrally molded. The belt holder 28 is made of super engineering plastics having enhanced mechanical strength and heat resistance, for example, resin such as PPS, PAI, and PEEK.

The flange 51 is constructed of a planar plate 51*d* and through-holes 51*a* and 52*b* produced through the plate 51*d* and used to attach the flange 51 to the cabinet 31 depicted in FIG. 8. For example, the bolts 32 depicted in FIG. 8 are inserted into the through-holes 51*a* and 52*b*, respectively, to fasten the flange 51 to the cabinet 31. As shown in FIG. 13, the flange 51 further includes a protrusion 51*c* protruding from the plate 51*d* in a direction opposite a direction in which the primary projection 53 projects from the base 52. The protrusion 51*c* positions the belt holder 28 with respect to the cabinet 31 as the belt holder 28 is attached to the cabinet 31.

The base 52 is formed into a ring or a tube projecting from the flange 51 toward a center of the fixing belt 21 in the axial direction thereof. As shown in FIG. 10, the protector 29 (e.g., a slip ring) is rotatably attached to or hung on the base 52. Thus, the base 52 and the protector 29 restrict movement of the fixing belt 21 in the axial direction thereof if the fixing belt 21 is skewed accidentally.

The primary projection 53 is formed into a ring or a tube projecting from the base 52 toward the center of the fixing belt 21 in the axial direction thereof. Since the primary projection 53, disposed opposite the inner circumferential surface of the fixing belt 21, contacts and supports the fixing belt 21 at each lateral end in the axial direction thereof, the primary projection 53 serves as an endless rotary body guide that guides the fixing belt 21 as it rotates in the rotation direction R3. As shown in FIG. 12, a recess 52*a* is produced across the primary projection 53 and the base 52 at the fixing nip N, that is, at a position opposite the through-holes 51*a* and 51*b* via the secondary projection 54 in the diametrical direction of the fixing belt 21. As shown in FIG. 10, each lateral end of the nip formation assembly 25 and the support 26 in the axial direction of the fixing belt 21 is situated inward from the recess 52*a*. Thus, the nip formation assembly 25 and the support 26, held by the belt holder 28 at each lateral end of the nip formation assembly 25 and the support 26 in the axial direction of the fixing belt 21, are supported by the cabinet 31 mounting the belt holder 28.

As shown in FIG. 13, the secondary projection 54 projects from a part of the primary projection 53 toward the center of the fixing belt 21 in the axial direction thereof. As shown in FIG. 10, the secondary projection 54 is disposed opposite the positioning portion 41*c* of the separation plate 41 of the separator 27 via the fixing belt 21. For example, the positioning portion 41*c* presses against the secondary projection 54 via the fixing belt 21. As shown in FIGS. 9 and 10, the belt holder 28 is mounted on the cabinet 31 such that the secondary projection 54 is disposed downstream from the nip formation assembly 25 in the rotation direction R3 of the fixing belt 21 or the recording medium conveyance direction A1.

As shown in FIG. 9, the secondary projection 54 is disposed opposite a back face 24*d* of the reflector 24 opposite the reflection face 24*b* that reflects light radiated from the heater 23 toward the fixing belt 21. Further, the secondary projection 54 is disposed opposite a back face 26*e* of the support 26 opposite the housing portion 26*b* depicted in FIG. 11A housing the heater 23.

The secondary projection 54 has a friction coefficient different from that of the primary projection 53. For example, a coefficient of static friction and a coefficient of kinetic friction of the secondary projection 54 are smaller than those of the primary projection 53, respectively. The friction coefficient of the secondary projection 54 may be smaller than that of the primary projection 53 by coating an outer circumferential face 54*a* of the secondary projection 54, disposed opposite the positioning portion 41*c* of the separation plate 41 of the separator 27 via the fixing belt 21, with fluoroplastic (e.g., fluorocarbon polymers).

Alternatively, the outer circumferential face 54*a* of the secondary projection 54 may be made of a material having a friction coefficient smaller than that of the primary projection 53, thus rendering the friction coefficient of the secondary projection 54 to be smaller than that of the primary projection 53. Yet alternatively, a piece made of a material having a friction coefficient smaller than that of the primary projection 53 may be embedded in or attached to the outer circumferential face 54*a* of the secondary projection 54.

With reference to FIG. 10, a detailed description is now given of a configuration of the protector 29.

As shown in FIG. 10, the protector 29 is a ring produced with a center through-hole 29*a* into which the primary projection 53 and the secondary projection 54 of the belt holder 28 are inserted. The protector 29 rotatably attached to or hung on the base 52 of the belt holder 28, together with the base 52, restricts movement of the fixing belt 21 in the axial direction thereof as the fixing belt 21 is skewed accidentally. As a lateral edge of the fixing belt 21 in the axial direction thereof comes into contact with a planar face of the protector 29 disposed opposite the lateral edge of the fixing belt 21, the protector 29 rotates in accordance with rotation of the fixing belt 21 by friction therebetween while the protector 29 remains in contact with the fixing belt 21. To address this circumstance, the protector 29 is made of a relatively elastic material that makes the planar face of the protector 29 smooth and relatively small in friction coefficient.

With reference to FIG. 10, a detailed description is now given of a configuration of the cabinet 31.

As shown in FIG. 10 illustrating one lateral end, that is, a right end, of the fixing device 100T in the axial direction of the fixing belt 21, the cabinet 31 includes a right side plate 31*a* mounting the belt holder 28 that supports the nip formation assembly 25 and the support 26 at a right end thereof. Although not shown, a left side plate is situated at another lateral end, that is, a left end, of the fixing device 100T in the axial direction of the fixing belt 21. Like the right side plate 31*a*, the left side plate mounts another belt holder 28 that supports the nip formation assembly 25 and the support 26 at a left end thereof. The cabinet 31 further includes a coupling plate that couples the right side plate 31*a* with the left side plate. Thus, the right side plate 31*a*, the left side plate, and the coupling plate are combined. The cabinet 31 mounts a grip gripped by a user to attach and detach the fixing device 100T to and from the body 2 of the image forming apparatus 1000 depicted in FIG. 1.

Figure 14A:
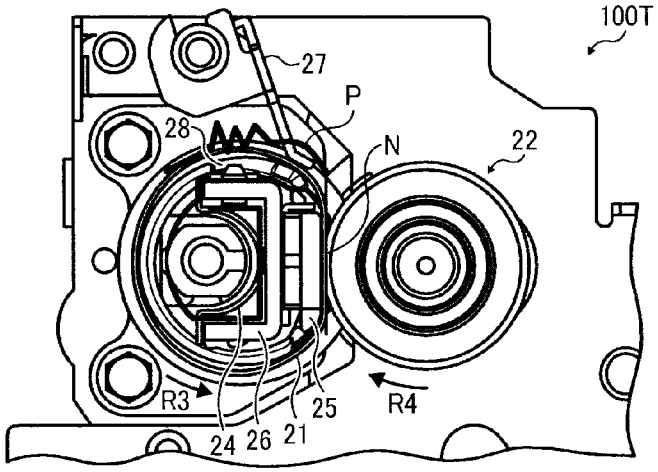
FIG. 14A is a vertical sectional view of the fixing device shown in FIG. 9 illustrating a recording medium jammed therein.
Figure 14B:
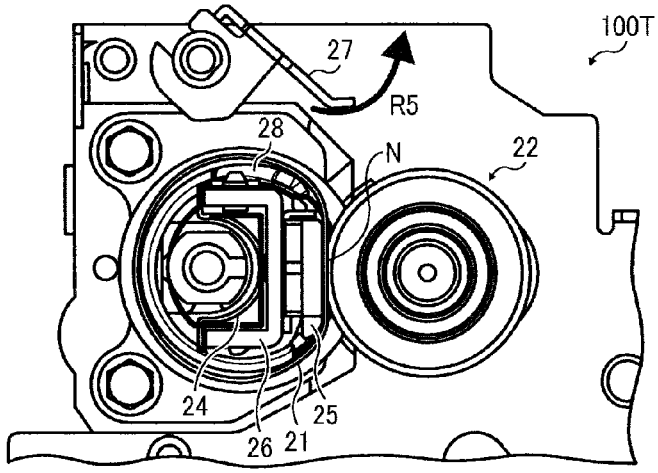
FIG. 14B is a vertical sectional view of the fixing device shown in FIG. 9 illustrating a separator incorporated therein that is spaced apart from the fixing belt.
Figure 14C:
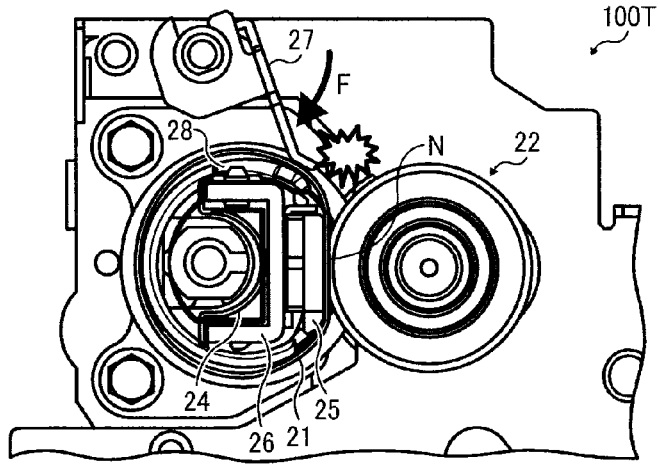
FIG. 14C is a vertical sectional view of the fixing device shown in FIG. 9 illustrating the separator coming into contact with the fixing belt.

With reference to FIGS. 14A, 14B, and 14C, a description is provided of operations of the separator 27 described above.

FIG. 14A is a vertical sectional view of the fixing device 100T illustrating a recording medium P jammed therein. FIG. 14B is a vertical sectional view of the fixing device 100T illustrating the separator 27 spaced apart from the fixing belt 21. FIG. 14C is a vertical sectional view of the fixing device 100T illustrating the separator 27 coming into contact with the fixing belt 21.

As shown in FIG. 14A, as a recording medium P is discharged from the fixing nip N, the separator 27 may fail to separate the recording medium P from the fixing belt 21 and thereby the recording medium P may be jammed between the fixing belt 21 and the separator 27 at a position downstream from the fixing nip N in the rotation direction R3 of the fixing belt 21. To address this circumstance, the user removes the jammed recording medium P from the fixing device 100T. Since the recording medium P is jammed between the fixing belt 21 and the separator 27, as the user pulls the jammed recording medium P, the separator 27 is rotated and lifted by the recording medium P in a rotation direction R5 and therefore the separator 27 is spaced apart from the fixing belt 21 as shown in FIG. 14B. After the jammed recording medium P is removed from the fixing device 100T, that is, after the jammed recording medium P separates from the separator 27 and thereby no longer lifts the separator 27, resilience F of a spring anchored to the separator 27 causes the positioning portion 41*c* of the separation plate 41 of the separator 27 to strike the fixing belt 21.

To address this problem, the fixing device 100T includes the secondary projection 54 of the belt holder 28 that is disposed opposite the positioning portion 41*c* of the separator 27 via the fixing belt 21 as shown in FIG. 10. Accordingly, even if the positioning portion 41*c* of the separator 27 strikes the fixing belt 21, the secondary projection 54 of the belt holder 28 supports the fixing belt 21 against impact exerted from the separator 27 onto the fixing belt 21. Consequently, the secondary projection 54 of the belt holder 28 absorbs impact exerted from the positioning portion 41*c* of the separator 27 to the fixing belt 21.

With reference to FIGS. 8, 9, 10, 12, and 13, a description is provided of advantages of the fixing device 100T described above.

As shown in FIG. 8, the fixing device 100T includes the fixing belt 21 serving as an endless rotary body rotatable in the rotation direction R3; the pressing roller 22 serving as a pressing body pressing against the outer circumferential surface of the fixing belt 21; the heater 23 disposed opposite the fixing belt 21 to heat the fixing belt 21; the nip formation assembly 25 pressing against the pressing roller 22 via the fixing belt 21 to form the fixing nip N through which a recording medium P bearing a toner image T passes; the support 26 contacting and supporting the nip formation assembly 25; the separator 27 disposed opposite the outer circumferential surface of the fixing belt 21 to separate the recording medium P discharged from the fixing nip N from the fixing belt 21; and the pair of belt holders 28 contacting and supporting the fixing belt 21 at both lateral ends in the axial direction thereof perpendicular to the recording medium conveyance direction A1.

As shown in FIG. 10, the belt holder 28 includes the base 52; the primary projection 53 projecting from the base 52 toward the center of the fixing belt 21 in the axial direction thereof; and the secondary projection 54 projecting from a part of the primary projection 53 toward the center of the fixing belt 21 in the axial direction thereof. The secondary projection 54 is disposed opposite the positioning portion 41*c* of the separator 27 via the fixing belt 21.

The secondary projection 54 of the belt holder 28 and the positioning portion 41*c* of the separator 27 prevent buckling and plastic deformation of the fixing belt 21. For example, as shown in FIG. 14B, as the user pulls and removes the jammed recording medium P from between the fixing belt 21 and the separator 27, the recording medium P rotates and lifts the separator 27 in the rotation direction R5. After the jammed recording medium P is removed from between the fixing belt 21 and the separator 27, resilience F of the spring anchored to the separator 27 may cause the separator 27 to strike the fixing belt 21, thus generating buckling and plastic deformation of the fixing belt 21.

To address this problem, the secondary projection 54 of the belt holder 28 is disposed opposite the positioning portion 41*c* of the separator 27. Accordingly, even if the separator 27 strikes the fixing belt 21, the secondary projection 54 supporting the fixing belt 21 absorbs impact exerted from the separator 27 onto the fixing belt 21. Consequently, the secondary projection 54 of the belt holder 28 prevents damages, that is, buckling and plastic deformation, of the fixing belt 21.

As shown in FIG. 9, the secondary projection 54 of the belt holder 28 is disposed downstream from the nip formation assembly 25 in the rotation direction R3 of the fixing belt 21. Hence, as the fixing belt 21 is driven and rotated in the rotation direction R3, the secondary projection 54 does not come into contact with the fixing belt 21. For example, at a position downstream from the nip formation assembly 25 in the rotation direction R3 of the fixing belt 21, the pressing roller 22 rotating in the rotation direction R4 pushes the fixing belt 21 away from the nip formation assembly 25, slackening the fixing belt 21 with decreased tension. Since the fixing belt 21 is slackened as it rotates, the fixing belt 21 does not strike the secondary projection 54. Accordingly, the fixing belt 21 contacts the secondary projection 54 with reduced friction therebetween, decreasing resistance between the rotating fixing belt 21 and the secondary projection 54 and thereby minimizing rotation torque of the fixing belt 21.

As shown in FIG. 9, the secondary projection 54 of the belt holder 28 is disposed opposite the back face 24*d* of the reflector 24 opposite the reflection face 24*b* of the reflector 24 that is disposed opposite the heater 23 to reflect light radiated from the heater 23. Accordingly, heat radiated from the heater 23 is not conducted to the secondary projection 54 directly. Consequently, it is not necessary to select a heat-resistant material for the belt holder 28, increasing flexibility in design and selection of moldable materials at reduced costs. Additionally, since heat radiated from the heater 23 is not conducted to the secondary projection 54 of the belt holder 28 directly, durability of the belt holder 28 improves.

As shown in FIG. 9, the secondary projection 54 of the belt holder 28 is disposed opposite the back face 26*e* of the support 26 opposite the housing portion 26*b* depicted in FIG. 11A housing the heater 23. Accordingly, like the reflector 24 described above, the support 26 prohibits heat radiated from the heater 23 from being conducted to the secondary projection 54 directly. Consequently, it is not necessary to select a heat-resistant material for the belt holder 28, increasing flexibility in design and selection of moldable materials at reduced costs.

Even if a front face 26*f* of the support 26 disposed opposite the heater 23 is configured to be mirror finished by coating or attaching of a reflection material, instead of attaching the reflector 24 to the support 26, the support 26 prohibits heat radiated from the heater 23 from being conducted to the secondary projection 54 directly. Hence, durability of the belt holder 28 improves.

For example, the coefficient of static friction and the coefficient of kinetic friction of the secondary projection 54 are smaller than those of the primary projection 53, respectively, by coating the secondary projection 54 with fluoroplastic or using a material for the secondary projection 54 that is different from a material used for other components. Accordingly, even if a fixing belt that differs from the fixing belt 21 in design specification is installed in the fixing device 100T and the fixing belt 21 receives a force that may twist or warp the fixing belt 21 as the fixing belt 21 slides over the secondary projection 54, the coefficient of static friction and the coefficient of kinetic friction of the secondary projection 54 that are smaller than those of the components other than the secondary projection 54, for example, the primary projection 53, prevent the fixing belt 21 from being twisted and warped. Consequently, the fixing belt 21 rotates smoothly, improving its durability.

Further, even if the fixing belt 21 comes into contact with the secondary projection 54, the coefficient of static friction and the coefficient of kinetic friction of the secondary projection 54 that are smaller than those of the components other than the secondary projection 54 decrease resistance between the rotating fixing belt 21 and the secondary projection 54, minimizing torque required to rotate the fixing belt 21.

The fixing device 100T is installable in the image forming apparatus 1000 depicted in FIG. 1. Accordingly, even if the separator 27 strikes the fixing belt 21 upon removal of the jammed recording medium P from between the fixing belt 21 and the separator 27, the secondary projection 54 of the belt holder 28 that supports the fixing belt 21 absorbs impact exerted from the separator 27 onto the fixing belt 21, thus preventing damages, that is, buckling and plastic deformation, of the fixing belt 21. Consequently, durability of the image forming apparatus 1000 improves. Additionally, heat radiated from the heater 23 is not conducted to the secondary projection 54 directly. Consequently, it is not necessary to select a heat-resistant material for the belt holder 28, increasing flexibility in design and selection of moldable materials at reduced costs. As a result, the image forming apparatus 1000 provides flexibility in design at reduced costs. Since the belt holder 28 has the decreased coefficient of static friction and the decreased coefficient of kinetic friction, it minimizes damage and abrasion of the fixing belt 21, enhancing durability of the fixing belt 21. Thus, the image forming apparatus 1000 incorporating the durable fixing belt 21 enhances its durability.

The fixing device 100T depicted in FIG. 9 that includes the separator 27 and the belt holder 28 may incorporate the shield 133 depicted in FIGS. 5 and 7.

Figure 15:
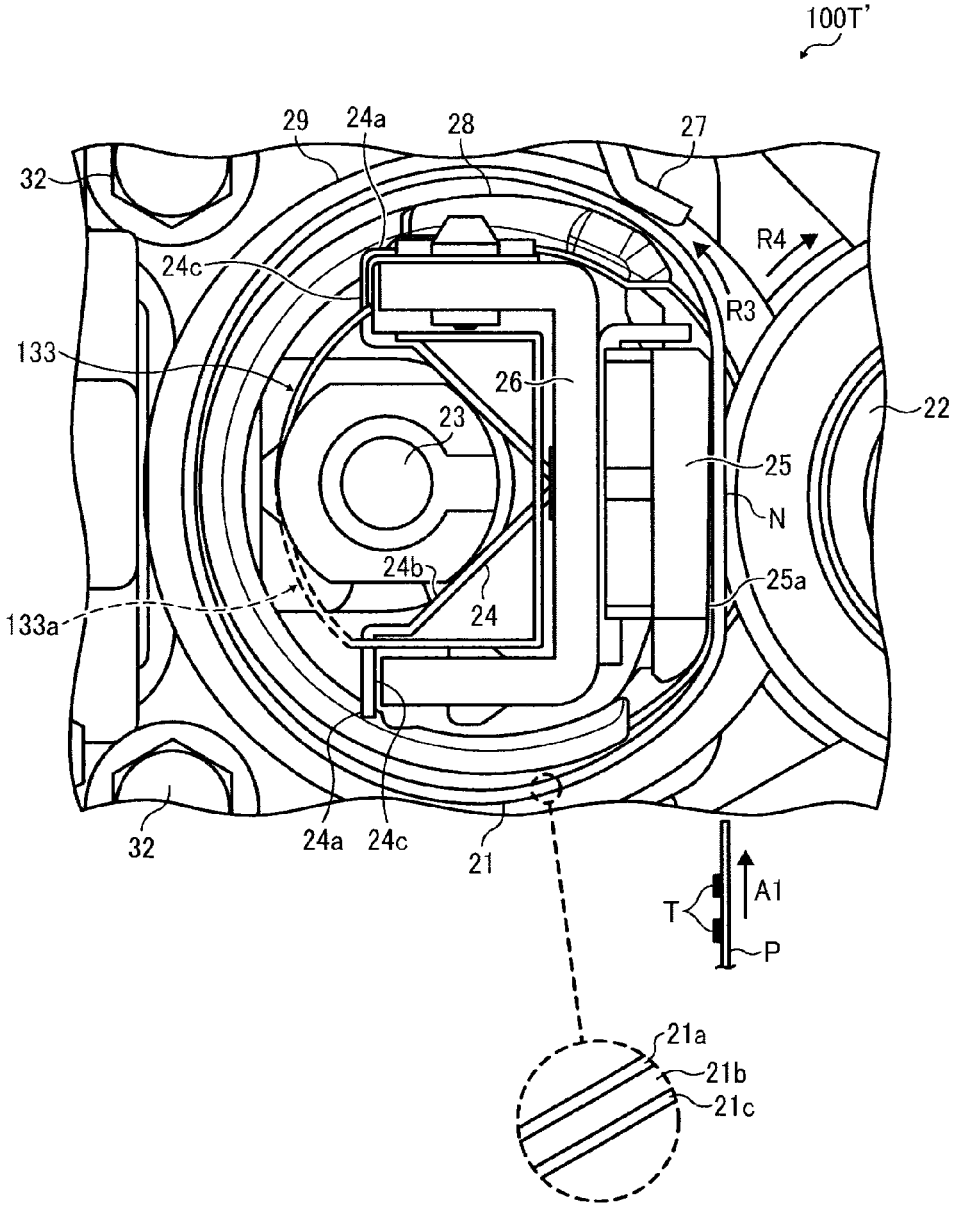
FIG. 15 is a partial vertical sectional view of a fixing device according to a fourth exemplary embodiment of the present invention.

With reference to FIG. 15, a description is provided of a configuration of a fixing device 100T' according to a fourth exemplary embodiment that incorporates the shield 133 having the notch 133*a*.

FIG. 15 is a partial vertical sectional view of the fixing device 100T'. The fixing device 100T' has a configuration equivalent to the configuration of the fixing device 100T described above.

As shown in FIG. 15, the fixing device 100T' includes the shield 133 having the notch 133*a* shown in FIGS. 5 and 7. Alternatively, the heater 23 may be replaced by the halogen heaters 123A, 123B, and 123C depicted in FIG. 5 or the halogen heater 123H depicted in FIG. 7. Further, the fixing devices 100 and 100S depicted in FIGS. 2 and 7, respectively, may incorporate the separator 27 and the belt holder 28 shown in FIG. 10.

According to the exemplary embodiments described above, the pressing rollers 122 and 22 serve as a pressing body disposed opposite the fixing belts 121 and 21, respectively. Alternatively, a pressing belt, a pressing plate, a pressing pad, or the like may serve as a pressing body.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a hollow, endless rotary body rotatable in a predetermined direction of rotation;

a pressing body contacting an outer circumferential surface of the endless rotary body to form a fixing nip therebetween through which a first size recording medium bearing a toner image and a second size recording medium bearing a toner image and being greater than the first size recording medium in width in an axial direction of the endless rotary body pass, the first size recording medium passing over a first passage region of the endless rotary body and the second size recording medium passing over a second passage region of the endless rotary body;

at least one heater disposed opposite an inner circumferential surface of the endless rotary body to heat the endless rotary body; and a shield interposed between the endless rotary body and the at least one heater to shield the endless rotary body from heat radiated from the at least one heater, the shield including a notch, an entirety of the notch being disposed only opposite a lateral end of the second passage region of the endless rotary body in the axial direction of the endless rotary body, wherein the lateral end of the second passage region overlaps a non-passage region of the endless rotary body in the axial direction thereof where the first size recording medium does not pass.

2. The fixing device according to claim 1, wherein the at least one heater includes:

a first heater disposed opposite a lateral end of the first passage region of the endless rotary body in the axial direction thereof; and a second heater disposed opposite the lateral end of the first passage region and the lateral end of the second passage region of the endless rotary body in the axial direction thereof, and wherein the shield is disposed opposite the first heater and the second heater.

3. The fixing device according to claim 2, wherein the second heater is disposed downstream from the first heater in the direction of rotation of the endless rotary body.

4. The fixing device according to claim 2, wherein the second heater heats the lateral end of the second passage region of the endless rotary body through the notch of the shield.

5. The fixing device according to claim 4, wherein the shield further includes:

a body; and an upstream arm projecting from the body toward a center of the endless rotary body in the axial direction thereof and disposed upstream from the notch in the direction of rotation of the endless rotary body, and wherein the notch is formed into substantially a rectangle extending in the axial direction of the endless rotary body along the adjacent upstream arm.

6. The fixing device according to claim 5, wherein the upstream arm of the shield shields the lateral end of the second passage region of the endless rotary body from heat radiated from the first heater.

7. The fixing device according to claim 2, wherein the at least one heater further includes a third heater disposed opposite a third passage region of the endless rotary body where a third size recording medium bearing a toner image and being smaller than the first size recording medium in width in the axial direction of the endless rotary body passes.

8. The fixing device according to claim 7, further comprising a nip formation assembly to press against the pressing body via the endless rotary body, wherein three axes of the first heater, the second heater, and the third heater constitute three vertices of a triangle in cross-section, and wherein the second heater is interposed between the nip formation assembly and the first and third heaters in a diametrical direction of the endless rotary body.

9. The fixing device according to claim 1, further comprising a guide to contact the inner circumferential surface of the endless rotary body at a lateral end of the endless rotary body in the axial direction thereof and to guide the endless rotary body rotating in the predetermined direction of rotation, wherein the shield is disposed opposite the guide to shield the guide from heat radiated from the at least one heater.

10. The fixing device according to claim 1, further comprising a dissipater contacting the shield to dissipate heat conducted from the shield.

11. The fixing device according to claim 1, wherein an opposed face of the shield disposed opposite the at least one heater has an overall reflectance not greater than about 80 percent.

12. The fixing device according to claim 1, wherein the shield has resistance against temperatures up to about 400 degrees centigrade.

13. An image forming apparatus comprising:

an image carrier;

an electrostatic latent image formation device disposed opposite the image carrier to emit light thereto to form an electrostatic latent image thereon;

a development device disposed opposite the image carrier to supply toner to the electrostatic latent image formed thereon to visualize the electrostatic latent image into a toner image;

a transfer device disposed opposite the image carrier to transfer the toner image formed thereon onto a recording medium; and the fixing device according to claim 1 disposed downstream from the transfer device in a recording medium conveyance direction to fix the toner image on the recording medium.

* * * * *